US008443936B1

(12) United States Patent
Raymond

(10) Patent No.: US 8,443,936 B1
(45) Date of Patent: May 21, 2013

(54) SELF-CONTAINED WORK PLATFORM ATTACHMENT FOR MOBILE CRANES

(76) Inventor: Timothy James Raymond, Brandenton, FL (US)

( * ) Notice: Subject to any disclaimer, the term of this patent is extended or adjusted under 35 U.S.C. 154(b) by 160 days.

(21) Appl. No.: 13/219,651

(22) Filed: Aug. 27, 2011

Related U.S. Application Data

(60) Provisional application No. 61/456,868, filed on Nov. 15, 2010.

(51) Int. Cl.
*B66F 11/04* (2006.01)

(52) U.S. Cl.
USPC ..... 182/2.1

(58) Field of Classification Search
USPC ..... 182/2.1–2.11
See application file for complete search history.

(56) References Cited

U.S. PATENT DOCUMENTS

| | | | | | |
|---|---|---|---|---|---|
| 4,331,215 | A | * | 5/1982 | Grove et al. | 182/2.1 |
| 4,418,791 | A | * | 12/1983 | Frey-Wigger | 182/150 |
| 4,518,059 | A | * | 5/1985 | Frey-Wigger | 182/2.7 |
| 4,537,281 | A | | 8/1985 | Endres | |
| 4,553,632 | A | | 11/1985 | Griffiths | |
| 4,653,654 | A | | 3/1987 | McDaniel | |
| 4,754,840 | A | * | 7/1988 | MacDonald et al. | 182/2.3 |
| 4,799,573 | A | | 1/1989 | Simnovec et al. | |
| 6,036,035 | A | | 3/2000 | Asano | |
| 6,585,079 | B1 | * | 7/2003 | Weyer | 182/2.7 |
| 7,926,670 | B2 | | 4/2011 | Schneider | |
| 8,016,074 | B2 | * | 9/2011 | Black et al. | 182/113 |
| 2002/0144862 | A1 | * | 10/2002 | Engvall et al. | 182/18 |
| 2004/0262078 | A1 | * | 12/2004 | Bailey | 182/2.1 |

* cited by examiner

*Primary Examiner* — Alvin Chin Shue
(74) *Attorney, Agent, or Firm* — Dorothy S. Morse

(57) ABSTRACT

A self-contained and ready-to-use work platform attachment for mobile cranes, which transforms them into a state-of-the-art aerial boom lift with powered platform leveling and powered rotation up to 180-degrees. It can be supplied by the crane manufacturer with a new crane, or as an after-market attachment add-on, and may be easily pinned to the swing-jib mounting system on the outermost boom tip sheave head present on most mobile cranes without adaptive components or crane modification. In contrast, current work platforms and baskets only have gravity-leveling in association with 180-degrees of unrestricted platform rotation range, and current aerial lift boom trucks, which can function as crane booms, are not designed for add-on or after-market self-contained pin-on work platforms, instead having an integrally-designed platform with rotation and leveling powered from a base unit via hose and cable reels or carries, which are not required with the self-contained and ready-to-use work platform attachment.

20 Claims, 14 Drawing Sheets

SELF-CONTAINED WORK PLATFORM ATTACHMENT FOR MOBILE CRANES

CROSS-REFERENCES TO RELATED APPLICATIONS

The applicant herein requests domestic priority for the instant application based upon his earlier filed, U.S. provisional patent application for similar subject matter, which has a title of "Universal crane work platform after-market attachment", a U.S. provisional application number of 61/456,868, and a filing date of Nov. 15, 2010.

BACKGROUND

1. Field of the Invention

This invention relates to work platforms used with cranes and telescopic boom assemblies, particularly to a universal self-contained work platform attachment with auto-powered leveling and rotation for mobile and boom truck cranes, wherein when such mobile and boom truck cranes include a swing-jib mounting system, the invention can be mounted to the standard crane tip swing-jib mounting plates already incorporated therein, advantageously using the existing pinning holes and pins provided by the swing-jib boom system's manufacturer. It is also contemplated for the present invention to be used with telescopic boom assemblies, and it becomes securely mounted thereto using only the previously mentioned mounting plates, and does not require any additional bolting, welding, or attachment of any other fixtures where the telescopic boom assembly incorporates a swing-jib attachment system. The auto-powered leveling and rotation capability of the present invention, among its other features and advantages, can instantly transform any crane with a swing-jib attachment system into a modern day state-of-the-art aerial lift, which has not been done before. Another advantage of the present invention is that its size and load capacity can be made greater than most prior art man baskets used with mobile and boom truck cranes, providing a greatly increased work area envelope with more side reach and greater height. The onboard powered-leveling system of the present invention work platform attachment maintains the platform in a level orientation, as the attached crane boom is articulated up or down, regardless of the location of its load's center of gravity relative to the platform, including cantilevered and off-set loads. The present invention also incorporates a rotation mechanism that allows 180-degree platform rotation when fully-loaded, with the option of stable/balanced vertical articulation leveling and platform rotation at the same time. Further advantages of the present invention include, but are not limited to, a redundant ground-operated radio remote control system having the same functions as the control box on the platform, platform positioning above the boom and boom tip that allows unrestricted work access above and around the boom tip, and legal road travel, as when the crane boom to which a present invention platform is attached is stowed over the chassis cab, the platform's very compact and low profile design is able to fit within the permitted legal-road-travel envelope while it is secured to the boom tip swing-jib mounting plates (also referred to elsewhere herein as 'swing-jib brackets'). In addition, since the present invention is a self-contained and fully functioning platform, it could also be attached to cranes and telescopic boom assemblies without a swing-jib attachment system, however, crane modification (bolting, welding, and/or other) is typically required to provide a secure work platform attachment point.

2. Description of the Related Art

The mobile crane boom industry has advanced many new crane designs and other product technology over the last 15 years by adding new features and design improvements, such as stronger materials, onboard load-monitoring computers, optional radio remote controls that allow operation of all crane functions from the work platform, load-sensing computerized hydraulic systems, and much more. The one area that has not advanced is work platforms, and those in use today are basically the same as 40 years ago. A description of what historically has been, and still is, standard for the crane industry regarding removable or pin-on work platforms follows below. Some disadvantages of this prior art are also mentioned below, along with information relating to dedicated work platforms having structure specific to a particular manufacturer or model.

The standard crane work platform in use today incorporates a pendulum-style gravity-leveling system wherein the platform hangs from, or pivots on, a shaft, with three designs or types of such platform attachments currently used with boom truck cranes. All three of these types of prior art platforms have restricted work access above and around the boom tip (in contrast to the present invention which has unrestricted overhead access). One prior art pendulum-style gravity-leveling platform is attached to a pivot pin on the side of crane boom, another has an attachment pivot pin inside the center of its platform and a rotation mechanism, and the third has its platform mounted to the end of the crane boom using a two-pin yoke-style hanging attachment. The platform mounted to the side of crane tip is limited in useable work range because the boom blocks much of the overhead work area, as well as work on the side of the platform attached to the crane. Also, while the prior art work platform with the centered pivot pin and rotation mechanism on the crane boom advantageously has 360-degree rotation, its pivot attached inside the basket takes up valuable platform payload space. Similarly, the generally U-shaped exterior support structure portion of the yoke-style platform's boom tip attachment design often obstructs the work access range of onboard personnel. While this center-mounted rotating/pivoting prior art platform on a crane boom advantageously has 360-degree rotation, its pivot is attached inside the basket, which takes up valuable platform payload space and also blocks overhead work access range. Furthermore, when cranes have their booms stowed over the chassis cab, a yoke-style platform attached to would hang too far below the boom for road-legal-travel, obstructing at least part of the driver's view of the road ahead. In contrast, the present invention platform has its platform-leveling pivot hinge pin located near its floor, which reduces its overall height and makes it much shorter and compact than a pendulum/gravity leveled platform. This enables road-legal travel for the present invention because its compact design allows it to be stowed less than the road-legal height limit of 13-feet and 6-inches, and also allows its bottom surface to clear the chassis cab roof, while the present invention's rotation capability allows its platform to be positioned outboard and parallel to the side of a crane boom, where it clears both the cab chassis roof and driver's vision.

Also important is that pendulum-style gravity-leveling platform designs have an inherent negative flaw that causes them to swing and rock if payload and people inside the platform move while the supporting crane is raised or lowered. In addition, when the prior art platform's brake is applied to lock the leveling, and any the onboard personnel of payload load in the platform subsequently moves to a new location, the center of gravity of the platform is also likely to change Thus, unless the personnel and/or other load are moved back to their original positions before the brake is released to re-establish the original center of gravity, or other provisions are taken to rebalance payload and/or personnel, upon brake release the platform will suddenly tilt out-of-level and chaotically throw the payload and personnel into the side rails of the platform, causing distress and damage. The same situation occurs when the brake is engaged and the platform is rotated. Should the center of gravity after rotation become significantly changed, when the brake is released the platform will swing violently. Even the pendulum platforms having a mechanical hand-rotation must have personnel and payload centered to maintain a level orientation and avoid violent swinging. Thus, historically during routine crane movement, a work platform's center of gravity had to be kept in line with its pendulum plumb line, with care taken at the outset to remember the initial balance and positioning of onboard personnel and loads, as well as care taken to rebalance onboard personnel and loads before the platform is rotated out of its locked position, otherwise it will be out-of-level with unpleasant and potentially dangerous consequences. In contrast, the present invention platform has auto-powered leveling that instantly compensates for any changes in the platform's center of gravity due to repositioning movement of payload and/or personnel, and does not allow chaotic movement to occur at elevation upon brake release.

The present invention platform is also distinguishable from the manufacturer-dedicated platforms currently in use with mobile crane booms. Mobile crane boom manufacturers do not currently offer, nor are mobile crane booms designed for, a factory-ready (or an after-market) self-contained work platform that employs, adapts, and/or otherwise incorporates modern aerial lift features with self-platform leveling and rotation, and any attempt to do so by means other than the self-contained and self-powered work platform attachment herein would require modification to the entire mobile crane boom assembly to supply the associated platform with power (hydraulic or electric) for its needed platform leveling and rotational features, and would also require a new mechanically-designed platform mounting structure and assembly. Furthermore, for well over twenty years, many aerial lift boom trucks have had work platforms or baskets that allow them to function as cranes. While these work platforms and baskets have many features and mechanisms that are similar to those of the instant invention, such as powered mechanical leveling or platform rotation, these work platforms are also designed and manufactured with many dedicated/integral components that work only with their own specifically designed product, and cannot be easily adapted for other use. In addition, the platform mounting bracket typically used to secure a dedicated work platform to a main crane boom has a vertical height similar to that of the work platform, with the connection thereto involving a substantial portion of one side of the platform. In contrast, the connecting/support member used between the present invention work platform attachment and swing-jib sheave head mounting plates is (in comparison) a substantially planar platform mounting structure that is advantageously connected to the base/bottom surface of the work platform attachment, making the present invention structure different and distinguishable from known manufacturer-dedicated work platforms. Furthermore, such platforms are not self-contained, and power from the associated truck is needed for its work platform leveling and rotation functions. Thus, such prior art platforms are not designed to function as an after-market add-on work platform attachment, as is the present invention, instead being an original and dedicated integral component of its associated aerial lift boom truck. In addition, these aerial lift boom trucks do not have a swing-jib or a boom tip designed sheave head configured for a swing-jib, and thus do not secure their platforms in position using a standard swing-jib pinning system. Instead, they are all designed to have a platform or basket attach to the outer boom tip by means of welded or bolted attachment points specifically designed for support of their individual platforms. Furthermore, in prior art and current aerial lift boom trucks, hydraulic or electrical power for platform leveling and rotation is typically supplied from the ground by the supporting vehicle, an auxiliary engine, or a large battery-powered power unit, via hose/cable carriers or retractable reels attached to the boom assemblies, none of which are required during use of the self-contained self-powered present invention embodiments.

Thus, in contrast to the prior art, the present invention comprises the following features and advantages which make it structurally distinguishable. Leveling of the present invention platform is accomplished by means of an onboard mechanically-powered automatic hydraulic/electronic leveling system that senses when the platform is in an out-of-level state, and then operates a hydraulic leveling cylinder to articulate the platform level while the crane boom is raised or lowered, regardless of the position of the platform, onboard personnel, or its payload. When the crane boom is stopped, the platform's leveling cylinder employs several holding valves that lock the platform into a level orientation. Thus, a loaded present invention platform can be safely rotated in the horizontal plane while it is in the locked position, and its load, including personnel, are also safe as a result of its powered-leveling while the boom is being raised or lowered. Also, in addition to powered-leveling, user-friendly and safer platform rotation will now be available on mobile cranes due to other integral design features of the present invention, including its strong rotational bearing and drive mechanism, a torsion-resistant tubular platform mount, and a rigid and strong structural mounting bracket that anchors the present invention platform to the strong structural swing-jib sheave head while transferring all torsion and bending moments induced by off-set platform loads to the swing-jib sheave head.

In contrast to the present invention, the only prior art form of rotation for mobile crane platform boom attached platforms currently available involves a cumbersome and antiquated design consisting of gravity leveling, and the use of a manual level-locking brake or cylinder, wherein those aboard the platform are required to rebalance its onboard personnel and payload as close as possible to original positioning, before brake/lock release to avoid experiencing chaotic platform movement should the platform's center-of-gravity change while at elevation. In addition, platform rotation in a prior art gravity-leveled platform is typically performed by an onboard operator manually hand-cranking a gear box rotation mechanism, positioned above the platform. This prior art design is dangerous, expensive to purchase, and not user-friendly. In contrast, the present invention platform advantageously incorporates a hydraulic-powered rotation drive gear assembly that can rotate it a total of 180-degrees, with the present invention platform being maintained in a level state during all rotation (0-to-180-degrees) and as the crane boom is raised or lowered. Furthermore, the total power supply, mechanical actuation, and function controls in the self-contained present invention are all encompassed in a self-contained 12-volt battery-powered power pack integral with its platform assembly, thus eliminating the need for connecting hoses or power cables alongside the booms or platform, as well as the need for hose reels or cable carriers, unless application dictates otherwise. In addition, a shear ball bearing and hydraulic gear drive mechanism in the present invention allows a very large 10-foot long cantilevered work platform to be mounted in an offset position relative to the crane boom, platform hinge pivot pin, or center of platform rotation, yet continuously maintained in a level orientation in all positions of rotation (0-to-180-degrees), even when its is fully loaded to its 1,000 pound capacity and rotated. The universal-style mounting design of the present invention also allows it to be mounted to most commercial crane boom ends having a swing-jib mounting system, as it is configured to use the swing-jib anchor points that most cranes now incorporate as a standard feature. The swing-jib mounting system allows for a simple 4-pin connection of the present invention platform to a crane boom end. In addition, the mechanically-powered leveling feature of the present invention allows for road-ready stowed travel on a crane's boom tip. Since it does not rely on a pendulum/gravity leveling system and its platform-leveling pivot hinge pin can be located near its floor, its overall height is reduced, making it much shorter and compact than a pendulum/gravity leveled platform, which enables standard boom truck cranes with the present invention attached to it to fit and travel within a road legal travel envelope on roads and highways. Present invention design also enables a 10-foot long platform to be rotated outboard and parallel to the side of a boom within road legal width requirements, while concurrently clearing the cab chassis roof and driver's vision, thus allowing large and small present invention platforms alike to be left on the crane boom end during road travel. In contrast, the current designs of prior art side-mounted and yoke-mounted crane work platforms instead typically have a long pendulum design with a low center-of-gravity configured to reduce the chaotic rocking motion during platform elevation change that can lead to injury/damage of personnel and payload. Thus, when stowed over a chassis cab, they are usually not compact, which prevents road-legal-travel in a mounted and ready-to-use position. While a shorter pendulum length would allow a shorter overall stowed height and the possibility of road-legal-travel, onboard personnel using such a platform would have the nearly impossible task of re-establishing a balanced position/location for people and payload before each brake release in advance of a platform elevation change, and if the needed balance is not substantially achieved, chaotic platform rocking would ensue.

After a review of patents on the U.S. Patent Office website using International Classifications 182/2.4, 182/2.9, 212/168, 212/300, and 340/685, the inventions thought to be the closest in structure to the present invention are those disclosed in U.S. Pat. No. 4,553,632, to Griffiths (1985), U.S. Pat. No. 7,926,670 to Schneider (2011), U.S. Pat. No. 4,537,281 to Endres et al. (1985), U.S. Pat. No. 4,653,654 to McDaniel, Jr. et al. (1987), U.S. Pat. No. 6,036,035 to Asano et al. (2000), and U.S. Pat. No. 4,799,573 to Simnovec et al. (1989). The Griffiths patent discloses an automatic leveling device for crane-boom-supported work baskets that senses and adjusts leveling via plumb sensors and potentiometers. The Griffiths invention also includes a battery that supplies power to an electronic leveling sensor, a servo valve, and an actuator for occasions when the basket needs to be electrically isolated from the ground. In 1983, when the Griffiths patent application was filed, others were making and using electronic leveling sensors on work baskets/platforms, such as those available from P-Q Controls in Bristol, Conn., but these baskets/platforms did not have onboard battery power. Also, after reading about the Griffiths, it is concluded that its basket is an integrally designed and incorporated part of its associated boom crane, as the Griffiths disclosure does not include any supportive layout instructions or design plans that would enable its basket to be an after-market work platform attachment. The Schneider invention discloses a gravity-leveling work platform that can be attached to the tip of a swing-jib crane boom and stowed for road-legal highway travel, however, the Schneider invention does not teach a work platform with the many features and advantages provided by the also stowable and road-legal present invention platform attachment. The Endres invention is a yoke-mounted platform having a gravity/pendulum leveling design and a brake that locks the leveled platform in-place when the boom is stopped, so that people can safely move around inside the platform without a risk of placing the platform in an out-of-level orientation. The Endres platform also incorporates a shock absorber that slows rotation of its arms 82 and 84 around pivot pins 94/96, which that could occur as a result of unbalancing movement by onboard personnel or payload before its lock/brake is released. After the 1985 Endres invention, newer art has similarly used a hydraulic cylinder with a fluid loop path from its extend side port to its retract side port (a plumbed-in line between the two ports being some sort of on/off hand-valve that stops fluid travel), which stops travel of the cylinder shaft and locks the platform against further movement. Although the shock absorber of the Endres invention is important for those moving around inside its work platform (to prevent them from tipping out when any unbalanced movement occurs), but a shock absorber feature is unnecessary in the present invention as a result of its onboard powered-leveling system. The McDaniels invention is a side-mounted gravity-leveled work platform that uses the swing-jib sheave head pinning point to attach itself to a crane boom. The side-mounted gravity-leveling system uses the same type of art employed in the Endres yoke-mounted platform system for leveling and locking its platform, which is distinguishable from the non-gravity-leveled present invention. The Simnovec invention is a self-leveling work platform with an overhead connection to a crane boom, and appears to be designed for a knuckle boom or an aerial lift boom. In contrast to the present invention, the Simnovec platform requires boom modification prior to its attachment. No other work platform attachment for mobile and boom truck cranes is known with the same structure or function, or to provide all of the features and advantages of the present invention.

BRIEF SUMMARY OF THE INVENTION

It is the primary object of this invention to provide a state-of-the-art universal and self-contained work platform attachment for mobile and boom truck cranes with a swing-jib mounting system, which has powered leveling and rotation, and becomes securely mounted to the standard crane tip swing-jib mounting plates using the existing pinning holes and mounting pins provided by the manufacturer of the swing-jib boom system. It is a further object of this invention to provide a work platform attachment that is also attachable to mobile and boom truck cranes not having a swing-jib mounting system, through use of bolting, welding, or attachment of other fixtures to the crane boom. It is also an object of this invention to provide a self-contained work platform attachment that can be used with telescopic boom assemblies. It is also an object of this invention to provide a self-contained work platform attachment that incorporates onboard mechanical, hydraulic, or electric actuator-powered leveling systems for platform leveling, wherein as the crane boom is articulated up or down, the work platform attachment maintains a level orientation regardless of the location of its load's center of gravity relative to the platform, including cantilevered and off-set loads. It is a further object of this invention to provide a work platform attachment that incorporates either an onboard hydraulic, electric, or manual rotation mechanism that allows the platform to rotate up to a total of approximately 180-degrees when fully loaded. It is also an object of this invention to provide a self-contained work platform attachment with redundant and back-up features that enhance safety of onboard personnel and payloads. It is a further object of this invention to provide a work platform attachment with mechanically powered leveling that allows the total design layout to be a very compact and low profile attachment when compared to the greater height needed in the standard prior art gravity leveling/pendulum platform design in current use today. It is also an object of this invention to provide a self-contained work platform attachment that is capable of road-legal travel while stowed over a chassis cab on boom tip swing-jib mounting plates.

In contrast to the prior art, the present invention quickly attaches to an existing crane boom end in a fully operational condition using only the four mounting pins supplied with the crane, and it may remain on the crane boom and still be within the envelope allowed for road-legal-travel. It also incorporates many state-of-the-art aerial lift work platform features including, automatic powered self-leveling, 180-degree powered platform rotation, and a platform design enabling the use of exceptionally long platforms (i.e. 10-foot in length) that can even be cantilevered. For present invention platforms longer than 4-feet from the center of platform rotation to the end of the platform's lengthwise structure, the rotation assembly can allow the platform to be positioned outboard and parallel to the crane boom, which streamlines the overall width of the combined crane and platform to fit the required road-travel-legal envelope. The self-contained present invention embodiments also have an onboard state-of-the-art hydraulic power package that incorporates off-the-shelf commercially available components, such as deep-cycle large-amp-hour marine batteries and a unitized power-pack consisting of a direct current (DC) motor, gear pump, fluid reservoir, and proportional electric/hydraulic solenoid valves. It also incorporates a state-of-the-art electronic level sensor and actuators controlled by an electronic control box with hand-operated electric joy sticks and switches that control auto-leveling, leveling over-ride, and platform rotation, in addition to an on/off switch used for manual adjustment of the level of platform, if needed, and a foot-actuated on/off switch to enable the auto-leveling operation. To meet aerial lift safety codes, the present invention platform control system incorporates a redundant ground-operated remote radio-operated control system (having the same functions as the control box on the platform) that allows personnel on the ground to control the platform leveling and rotation operations. Also, as a result of the structural integrity mentioned above, the present invention may further comprise optional pin-on platform-lifting forks secured to one or more of its platform's exterior sides for the purpose of carrying material for an intended work project, or a mini hydraulic jib boom with a lift cylinder and an electric winch. In addition, the control package of the present invention also includes a low-voltage back-up system with toggle switches (preferably 3-position) that are used to control the leveling and rotation of the present invention work platform attachment should battery voltage drop below 10.5 volts. The toggle switches and the back-up DC power system can be used to continue normal operation of a present invention platform, while it moves downwardly to the ground for battery replacement.

Although the universal and self-contained work platform attachment of the present invention is conveniently secured to new cranes or after-market cranes by using the crane manufacture's swing-jib mounting system, it is not limited to this type of mounting. If desired (and with the crane manufacturer's prior approval), the boom tip end of various crane booms without a swing-jib system, and other telescopic boom assemblies, can be modified to accommodate attachment of the present invention when use of a fully self-contained work platform is desired. Furthermore, the powered-leveling actuator of the present invention may comprise, but is not limited to, any of the current art forms, such as a hydraulic cylinder, or a hydraulic or electrical linear rotary-screw actuator. Present invention platform rotation may also be accomplished using current art, such as but not limited to, a slewing ring bearing used with a hydraulic (or electric) gear or worm-drive mechanism, or a hydraulic helical-rotation assembly. The self-contained DC power unit of the present invention, with its onboard and self-contained platform controls, is desired and preferred in many applications to achieve easy and convenient non-modified crane boom attachment (via use of a commonly available swing-jib mounting system). However, when the present invention is secured to a crane boom via manufacturer installation or by after-market crane modification (but without the use of a swing-jib mounting system), hydraulic or electric power for platform leveling and rotation functions may be supplied from the base unit or other remote systems by routing hoses or electrical cable to the platform by means of a hose/cable carrier or hose/cable reels.

DETAILED DESCRIPTION OF PREFERRED EMBODIMENTS

Figure 1:
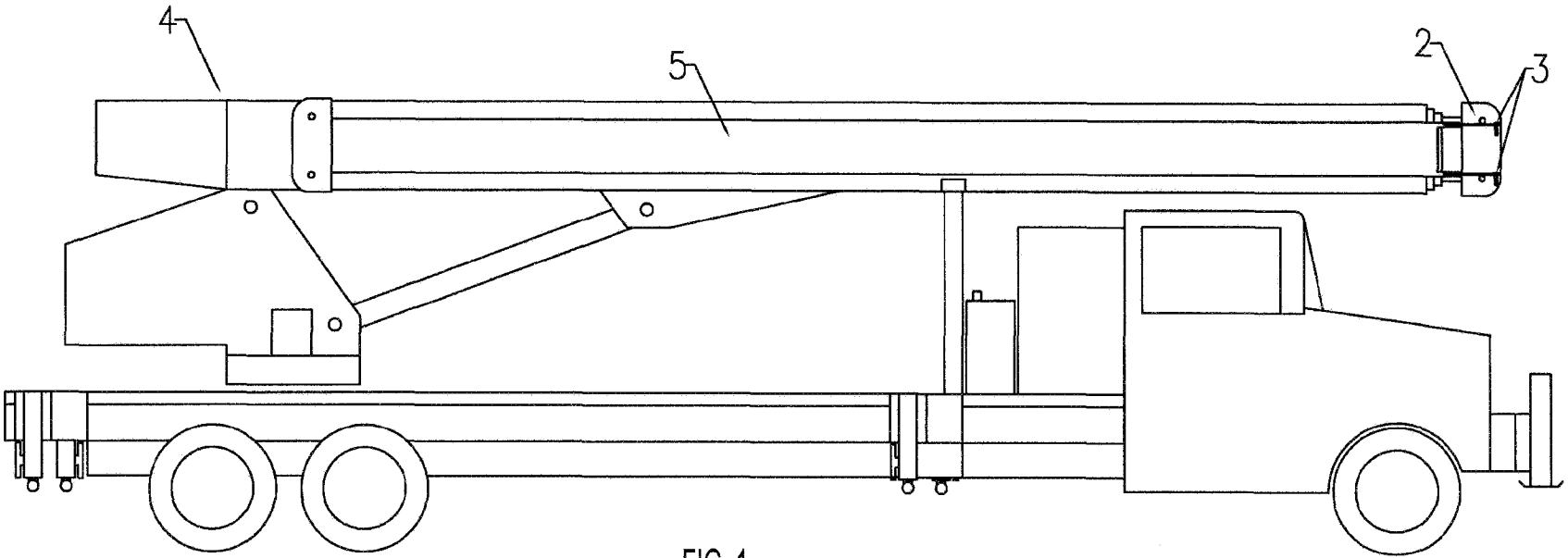
FIG. 1 PRIOR ART
FIG. 1 is a side elevation view of a prior art fully-operational mobile telescopic boom crane truck that is a fully designed and engineered machine capable of lifting, telescopic motion, and rotation of large loads within a work area determined by a load chart and work range chart, that also shows a swing-jib secured to the side of the truck's main crane boom in a road-travel-ready stowed position, and the sheave head on the end of the crane boom having nothing attached to it.

The description herein provides preferred embodiments of the present invention but should not be construed as limiting its scope. Instead, the scope of the present invention should be determined by the appended claims and their legal equivalents, rather than being limited to the examples given.

This invention provides a universal self-contained work platform attachment 11 primarily intended for use with mobile and boom truck cranes (shown in FIGS. 1-2 and 9-10, but it has no component number assigned to it) having s wing-jib boom 5 and a swing-jib mounting system with mounting plates 2 already secured on the end of its main crane boom 4. Thus, work platform attachment 11 can be secured to mounting plates 2 using only the existing pinning holes therein and the mounting pins 3 provided by the swing-jib boom 5 manufacturer. Although not shown in the accompanying illustrations, it is also contemplated for the present invention to be used with telescopic boom assemblies, and it becomes securely mounted thereto using only the previously mentioned mounting plates 2 and pins 3, and does not require any additional bolting, welding, or attachment of any other fixtures to a crane boom 4, or to a crane boom 4 tip end that incorporates a swing-jib mounting system with mounting plates 2. The present invention work platform attachment 11 incorporates a powered-leveling system (includes at a minimum linear leveling actuator 7, electronic leveling sensor 15, and platform control processor 17) that maintains work platform attachment 11 in a level orientation, wherein as main crane boom 4 is articulated up or down, work platform attachment 11 maintains a level orientation regardless of the current location of its load's center of gravity, including cantilevered and off-set loads. The present invention also incorporates a rotation mechanism (includes at a minimum hinge/pivot pins 9 and rotation bearing drive assembly 10) that allows a fully-loaded work platform attachment 11 to rotate through 180-degrees from its road-travel-ready stowed position. Further advantages of the present invention are a redundant ground-operated radio remote control system (see radio control receiver 16 marked in FIG. 13) having the same functions as the control box on work platform attachment 11, a very compact and low profile design, and road-legal travel while stowed on the main boom 4 tip's swing-jib sheave head mounting brackets 2. It is intended for the radio remote control system 16 to allow personnel on the ground to remotely conduct leveling and rotation operations of said work platform attachment 11 with or without personnel onboard. While FIGS. 1-8 show comparative prior art work platforms (gravity-leveled platforms 19-21 (in FIGS. 4-6), two unnumbered dedicated work platforms (shown in FIGS. 7 and 8), and FIGS. 9-18 show two preferred embodiments (1 and 30) of the present invention, it should be appreciated that the preferred embodiments of the present invention disclosed herein are being offered for illustrative purposes only. Thus, the scope of the present invention should be determined by the appended claims and their legal equivalents, rather than being limited to the examples given.

Figure 2:
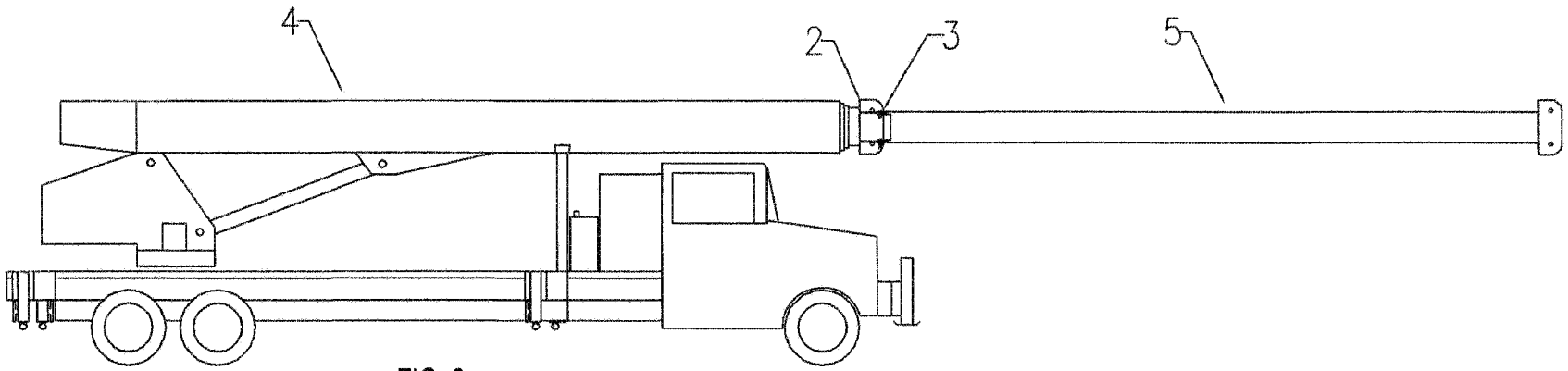
FIG. 2 PRIOR ART
FIG. 2 is a side elevation view of the prior art mobile crane truck shown in FIG. 1, with its swing-jib removed from its road-travel-ready stowed position and now attached to the swing-jib sheave head on the end of the crane boom via multiple swing-jib mounting pins.
Figure 3:
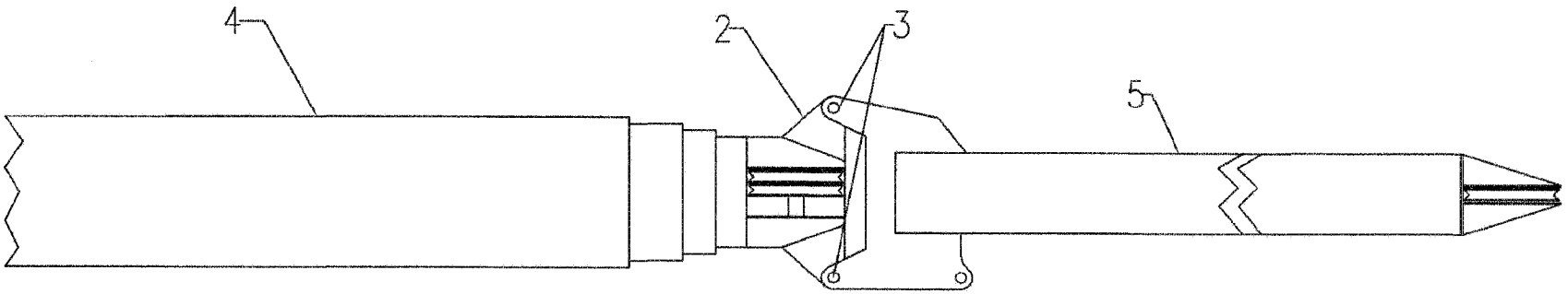
FIG. 3 PRIOR ART
FIG. 3 is a top view of the swing-jib shown in FIG. 2 mounted to the crane boom's swing-jib sheave head via swing-jib mounting pins.
Figure 9:
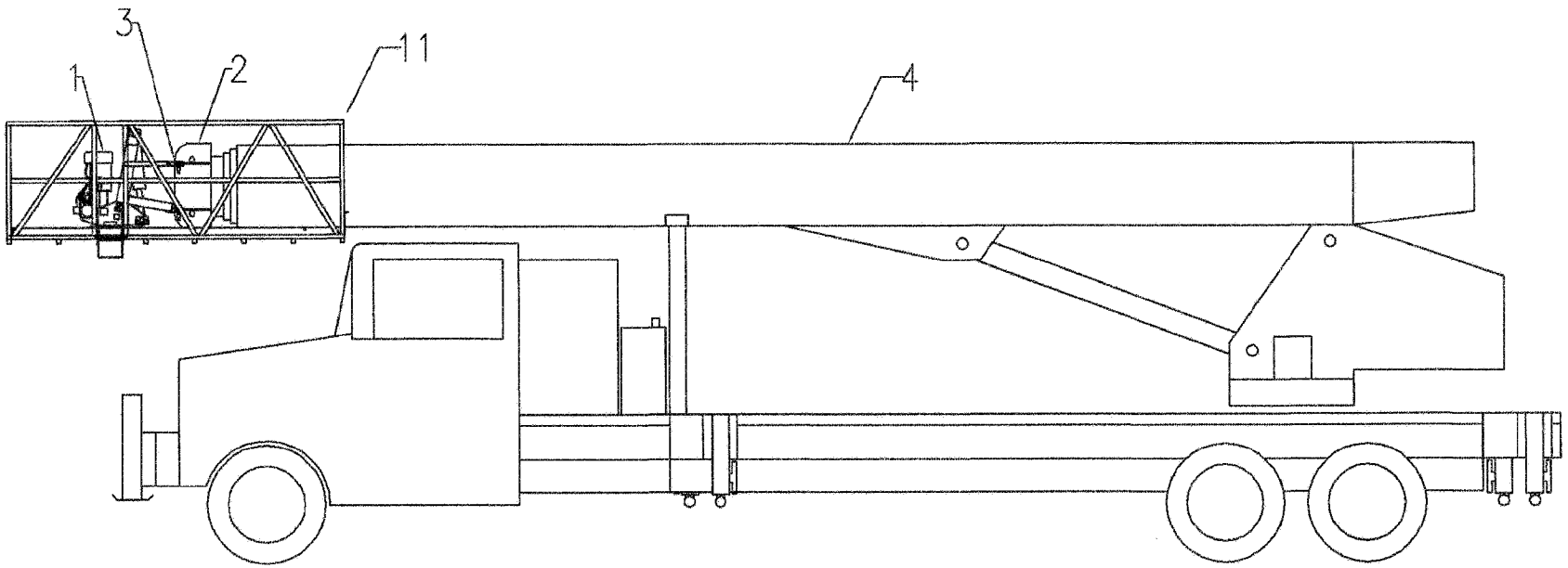
FIG. 9 is an elevation view of a large preferred embodiment of the present invention work platform attachment secured to the mobile telescopic boom crane truck previously shown in FIG. 1, with the crane boom having its swing-jib secured in a road-travel-ready stowed position on the hidden side of the main crane boom, and the present invention secured to the swing-jig sheave head mounting plates via mounting pins obtained from the swing-jib manufacturer, with FIG. 9 further showing the present invention rotated into a position outboard and parallel to the crane boom that is road-travel-legal, as well as the compact overall height of the present invention platform attachment that allows stowed positioning above the driver's windshield vision and below the maximum road legal height of 13-feet-and-6-inches.
Figure 10:
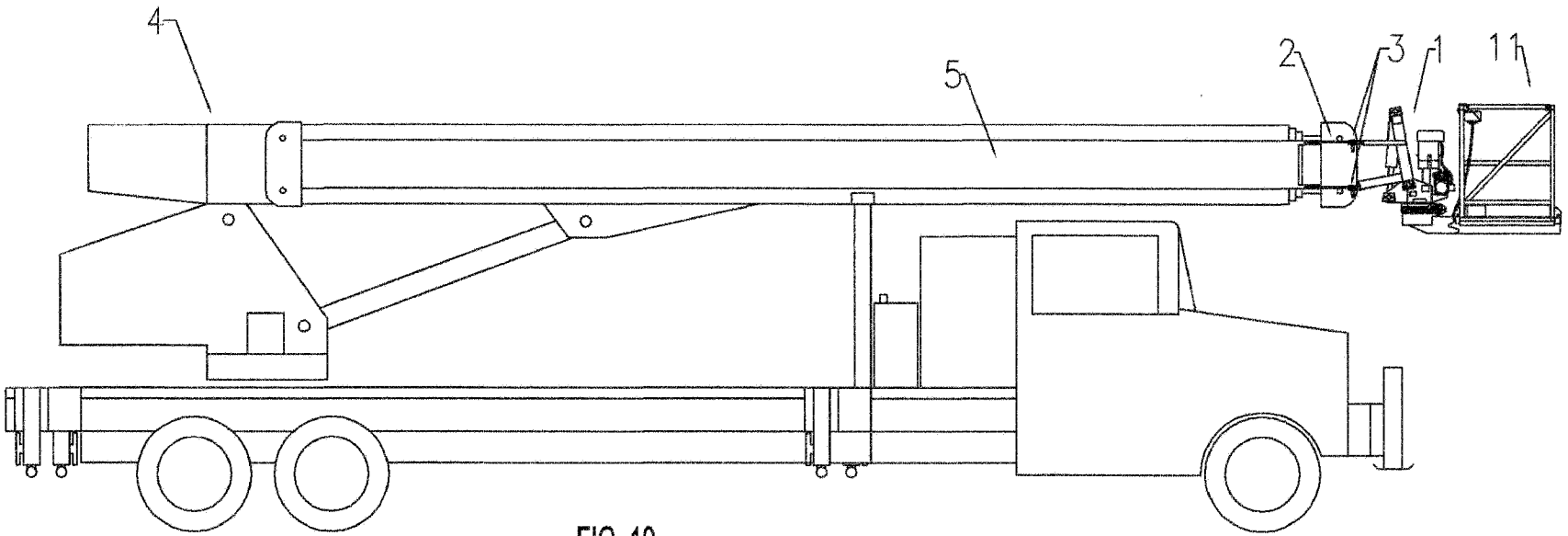
FIG. 10 is a side elevation view of a smaller preferred embodiment of the present invention work platform attachment secured to the swing-jig sheave head's mounting plates on the mobile telescopic boom crane truck previously shown in FIG. 9, with its main crane boom and swing-jib remaining in their road-travel-ready stowed and secured positions, and the present invention work platform now rotated into a stowage position in front of the main crane boom that is road-travel-legal and places the platform's longitudinal axis perpendicular to that of the crane boom.

FIGS. 1 and 2 both show a prior art mobile telescopic boom crane unit with its main boon crane 4 extending in a horizontal orientation above a supporting truck bed and cab. FIG. 1 is a side elevation view of the fully-operational main crane boom 4 in a stowed position ready for road travel, and a swing-jib boom 5 also in a horizontally-extending orientation (in part above the truck cab), with its swing-jib 5 stowed and secured adjacent to the side of main crane boom 4 in a road-travel-ready stowed position, while FIG. 2 is a side elevation view of the swing-jib 5 attached to the crane boom 4 via swing-jib sheave head mounting plates 2 and swing-jib mounting pins 3. FIGS. 1 and 2 both show a swing-jib sheave head with mounting plates 2 secured to the tip end of main boom crane 4. It is mounting plates 2 that are used to support the present invention work platform attachment (see FIG. 13). The swing-jib 5 shown in a stowed position in FIG. 1 is secured to the swing-jib sheave head's mounting plates 2 using four mounting pins 3 in FIG. 2, and in FIG. 2 is show in a horizontally-extending position projected beyond the front of the truck's cab. In FIGS. 1 and 2 only two of the four mounting pins 3 are visible (with the remaining two mounting pins 3 being used for securing a portion of mounting plates 2 hidden from view. The prior art mobile telescopic boom crane unit shown in FIGS. 1 and 2 is a fully designed and engineered machine capable of lifting, telescopic motion, and rotating large loads within a work area determined by a load chart and work range chart. Note that in FIG. 1 the swing-jib sheave head mounting plates 2 and swing-jib mounting pins 3 are shown idle and have nothing attached to them (the condition needed before the present invention work platform attachment 11 can be connected). It is contemplated for the present invention work platform attachment 11 to be secured to such a mobile telescopic boom crane (as is shown in FIGS. 9 and 10). In contrast, FIG. 3 is a top view of the prior art main crane boom 4 previously illustrated in FIGS. 1 and 2, and showing a crane swing-jib 5 secured to the swing-jib sheave head mounting plates 2 on the tip of the main crane boom 4 with four swing-jib mounting pins 3. When the present invention work platform attachment 11 is to be secured to main boom crane 4, swing-jib 5 is removed (if present), and work platform attachment 11 is alternatively attached to the same swing-jib sheave head mounting plates 2 using the same four mounting pins 3 provided by the manufacturer of swing jib 5.

Figure 6:
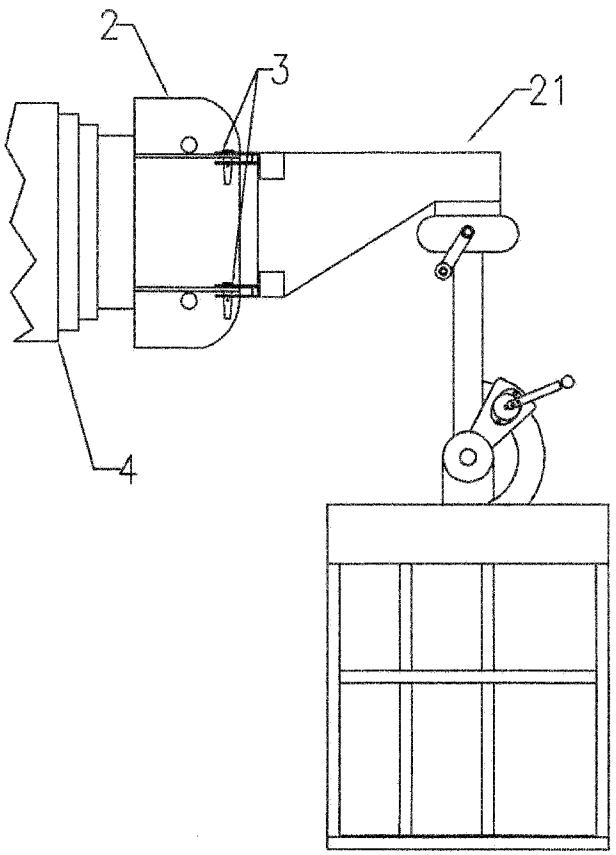
FIG. 6 PRIOR ART
FIG. 6 is a side elevation view of a third prior art center-mounted, hanging, gravity-leveled, and readily detachable work platform secured with swing-jib mounting pins to the swing-jib sheave head on the end of a crane boom, with this type of platform having 360-degree rotation capability and a locking system used to prevent the platform from tipping out personnel and payloads once a needed elevation is reached.
Figure 5:
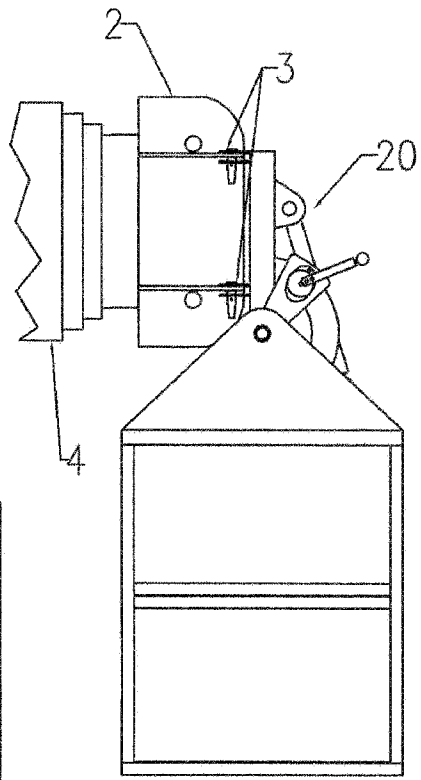
FIG. 5 PRIOR ART
FIG. 5 is a side elevation view of a second prior art side-mounted, gravity leveled, and readily detachable work platform secured with swing-jib mounting pins to the swing-jib sheave head on the end of a crane boom, with this type of platform also having a locking system used to prevent the platform from tipping out personnel and payloads once a needed elevation is reached, and no rotational capability.
Figure 4:
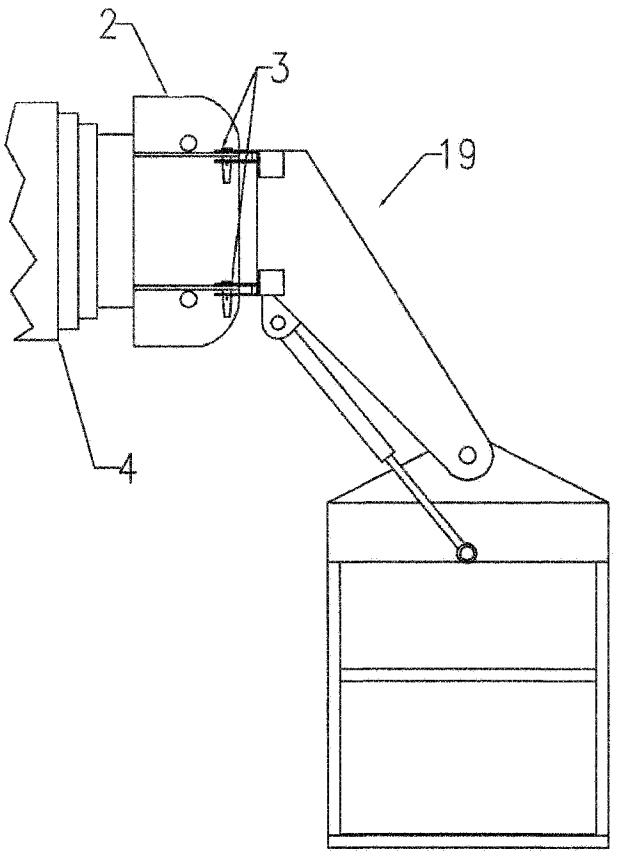
FIG. 4 PRIOR ART
FIG. 4 is a side elevation view of a first prior art yoke-mounted, gravity-leveled, and readily detachable work platform secured with swing-jib mounting pins to a swing-jib sheave head on the end of a crane boom, with this type of platform having a locking system used to prevent the platform from tipping out personnel and payloads once a needed elevation is reached, but not having any rotational capability.

FIGS. 4-6 show three detachable gravity-leveled prior art work platforms (respectively marked with the numbers 19, 20, and 21) that are patentably distinct from the present invention work platform attachment 11. FIG. 4 is a side elevation view of an example of a prior art yoke-mounted gravity-leveled work platform secured to a crane boom 4 using the same swing-jib sheave head mounting plates 2 shown in FIGS. 1 and 2, and also using the same four mounting swing-jib mounting pins 3 illustrated in FIGS. 1 and 2. FIG. 5 is a side elevation view of an example of a prior art side-mounted gravity-leveled work platform secured to a crane boom 4 using the same swing-jib sheave head mounting plates 2 shown in FIGS. 1 and 2, and also using the same four mounting pins 3 illustrated in FIGS. 1 and 2. FIG. 6 is also a side elevation view of an example of a prior art center-mounted and gravity-leveled work platform using the same swing-jib sheave head mounting plates 2 shown in FIGS. 1 and 2, and also using the same four mounting pins 3 illustrated in FIGS. 1 and 2. Prior art pivoting and yoke-style platform designs have an important negative flaw that causes them to swing and rock if payload and personnel onboard the platform move while the supporting crane is raised or lowered. In addition, when the prior art platform brake is applied to lock the leveling, and subsequently the onboard payload or personnel in the platform move to a new location and change the center of gravity for the platform, upon brake release the platform will suddenly tilt out-of-level and chaotically throw the payload and personnel into the side rails of the platform causing distress and damage. The same situation occurs when the brake is engaged and the platform is rotated. Should the center of gravity thereafter become significantly changed, when the brake is released the gravity-leveled platforms will swing violently. Even the pendulum platforms having a mechanical hand-rotation must have centered personnel and payload to maintain a level orientation and avoid violent swinging. In contrast, the present invention platform has powered-leveling that instantly compensates for any changes in the platform's center of gravity due to movement of personnel and/or payload, and does not permit chaotic movement upon brake release.

Figure 7:
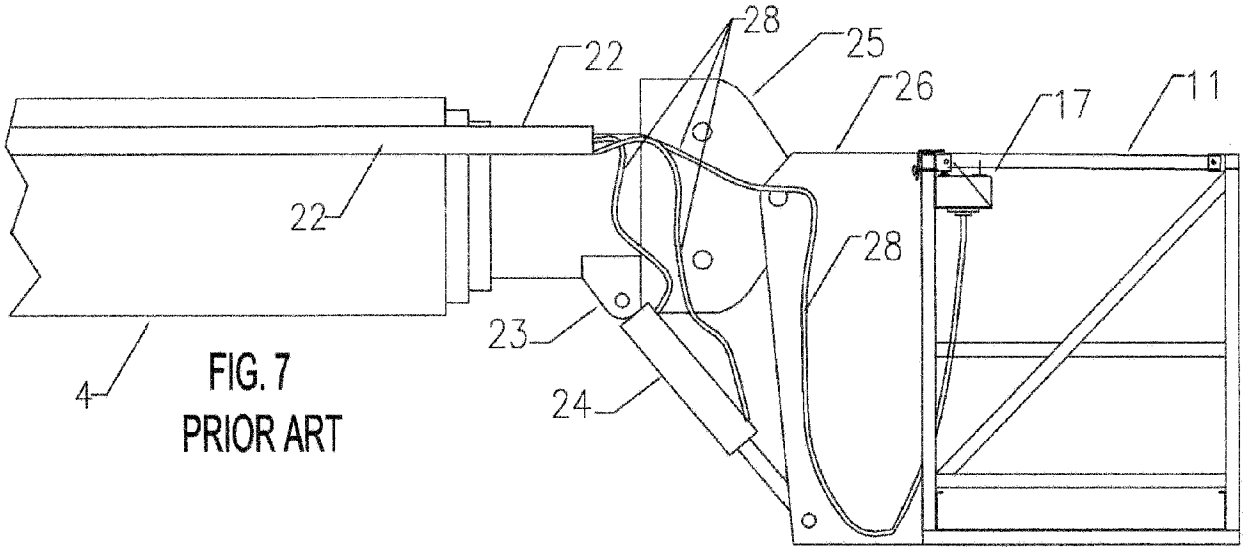
FIG. 7 PRIOR ART
FIG. 7 is a side elevation view of a first brand-dedicated prior art work platform typically found on aerial lift boom trucks, with this platform generally looking similar in over-all configuration to the present invention, except that the not-readily-attachable and brand-dedicated prior art platform has leveling cylinder and platform pivot anchoring points that are integrally fabricated into the basic crane boom design, it cannot be attached to a universal swing-jig sheave head without significant modification, and it does not have a self-contained onboard hydraulic power package or battery power.
Figure 8:
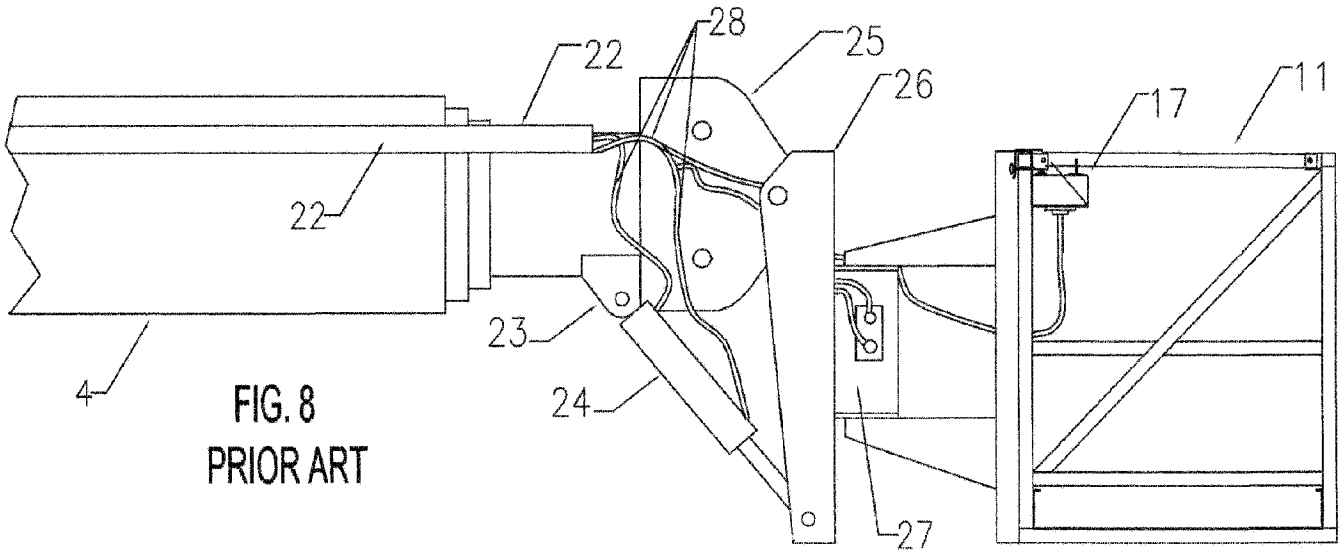
FIG. 8 PRIOR ART
FIG. 8 is a side elevation view of a second prior art brand-dedicated work platform, similar to that shown in FIG. 7, except that it also includes a mechanical rotation mechanism that allows platform rotation in combination with platform leveling.

FIGS. 7 and 8 show two manufacturer-dedicated prior art work platforms (each marked by the number 11) that receive power through hydraulic hoses and cables (22 and 28) connected to its supporting mobile telescopic boom crane unit via main crane boom 4. FIG. 7 a side elevation view of a first example of prior art used for dedicated mounting of a work platform 11 to a main crane boom 4, showing the hoses and cables (22 and 28) that are connected to a conventional aerial lift boom truck to provide power for the control processor 17 visible on work platform 11 (the same control processor 17 is shown in FIG. 8). The telescopic main crane boom 4 shown in both FIGS. 7 and 8 has a boom tip end 25 that is used to secure the dedicated work platform 11 to main crane boom 4 via a platform mounting bracket 26 and mounting pins (not shown). Although FIGS. 7 and 8 each show its platform mounting bracket 26 having a size and configuration different from that of the other, each shows its own platform mounting bracket 26 having a vertical height similar to that of the adjacent work platform 11, and connection between platform mounting bracket 26 and work platform 11 involving a substantial portion of one side of platform 11. In contrast, the connection used between the present invention work platform attachment 11 and swing-jib sheave head mounting plates 2 includes a substantially planar platform support structure 12 (see FIG. 13) advantageously secured to the base/bottom portion of work platform attachment 11. FIGS. 7 and 8 also show a prior art leveling cylinder 24 pinned to a cylinder anchor bracket 23 above it that is specifically designed for secure attachment to boom tip end 25. The other end of each leveling cylinder 24 is attached to the lower portion of platform mounting bracket 26. As leveling cylinder 24 extends and retracts, it will level the dedicated work platform 11 attached thereto, according to need. Hydraulic power to extend and retract leveling cylinder 24 and the control cable 28 used to provide electrical power for platform operational controls 17 (for leveling and/or rotation of work platform 11) are serviced from the mobile crane's base vehicle/unit via main crane boom 4, supplied through hoses and cables 28 to platform mounting bracket 26 by means of hose and cable carriers 22 or via hose and cable reels (not shown). Hose/cable carriers 22 mounted to the side of main crane boom 4 to mechanically route hydraulic power through hoses and cables to a leveling cylinder 24 associated with a work platform 11 is known prior art of aerial lift equipment. In contrast, the present invention is a self-contained and preferably self-powered work platform attachment 11 easily mounted via four mounting pins 3 to a typical mobile crane having a crane boom swing-jib sheave head with mounting plates 2, which when work platform 11 is 10-feet in length still allows 180-degree rotation to achieve work range advantage, as well as stowed positioning parallel to main crane boom 4 that is within the envelope required for road-legal-travel. FIG. 7 shows no means of rotation for its work platform 11. FIG. 8 is the same as FIG. 7, except that it has a mechanical rotation mechanism 27 that allows platform rotation in combination with platform leveling. Mobile crane booms 4 do not currently offer, nor are they designed for attachment of, an after-market self-contained and self-powered work platform 11 (such as that disclosed in the present invention), and any attempt to do so by means other than the self-contained and self-powered work platform attachment 11 herein would require modification to the entire boom crane assembly to supply that work platform with power (hydraulic or electric, as needed) for its platform leveling and/or rotation operations, and would also require a new mechanically-designed platform mounting structure and assembly. While manufacturer-dedicated prior art work platforms 11 (such as those shown in FIGS. 7 and 8) have many features and mechanisms that are similar to those of the instant invention, such as powered mechanical leveling or platform rotation, these work platforms 11 are designed and manufactured with many dedicated/integral components that work only with their own specifically designed product, and cannot be easily adapted for other use. Thus, in that respect, they also are distinguishable from the present invention. Furthermore, as shown in FIGS. 7 and 8, prior art and current aerial lift boom trucks typically supply hydraulic and/or electrical power for platform leveling and rotation from the ground, via the supporting vehicle, an auxiliary engine, or a large battery-powered power unit, with hose/cable carriers 22 or retractable reels (not shown) attached to the boom assemblies, none of which are required during use of a present invention work platform attachment 11 that is self-contained and self-powered.

FIGS. 9 and 10 respectively show the most preferred embodiment 1 of the self-contained present invention leveling and rotation assembly, with its work platform attachment 11 secured to a mobile main crane boom 4 having a substantially horizontally-extending orientation, with the work platform attachment 11 shown in FIG. 10 being smaller in size than that is FIG. 9, which allows stowed positioning in front of the cab and above the driver's vision. FIG. 9 is a side elevation view of a mobile crane 4 with the larger work platform attachment 11 attached to swing-jib sheave head mounting plates 2 with swing-jib mounting pins 3. In FIG. 9, work platform attachment 11 is rotated outboard and parallel to main crane boom 4, and is shown in its stowed and road-travel-ready position. Although not shown, the smaller work platform attachment 11 shown in FIG. 10 may also be stowed in an outboard and parallel position relative to main crane boom 4. The compact overall height of work platform attachment 11, and the use of substantially planar platform support structure 12 for connection of work platform attachment 11 to main crane boom 4, allows the bottom of work platform attachment 11 to stow above the driver's windshield vision while the top of work platform attachment 11 remains below the road-legal height of 13-feet-and-6-inches. FIG. 10 is a side elevation view showing a crane swing-jib 5 in its stowed position secured to side of main crane boom 4, and a shorter work platform attachment 11 that allows road-legal-travel in a stowage position perpendicular to main crane boom 4. Thus, present invention embodiments with shorter work platform attachment 11 lengths may have two alternate stowed positions (parallel and perpendicular to main crane boom 4), while in order to meet road-legal-travel requirements, present invention embodiments with longer work platform attachment 11 lengths may only be stowed outboard and parallel to main crane boom 4 (as shown in FIG. 9).

Figure 11:
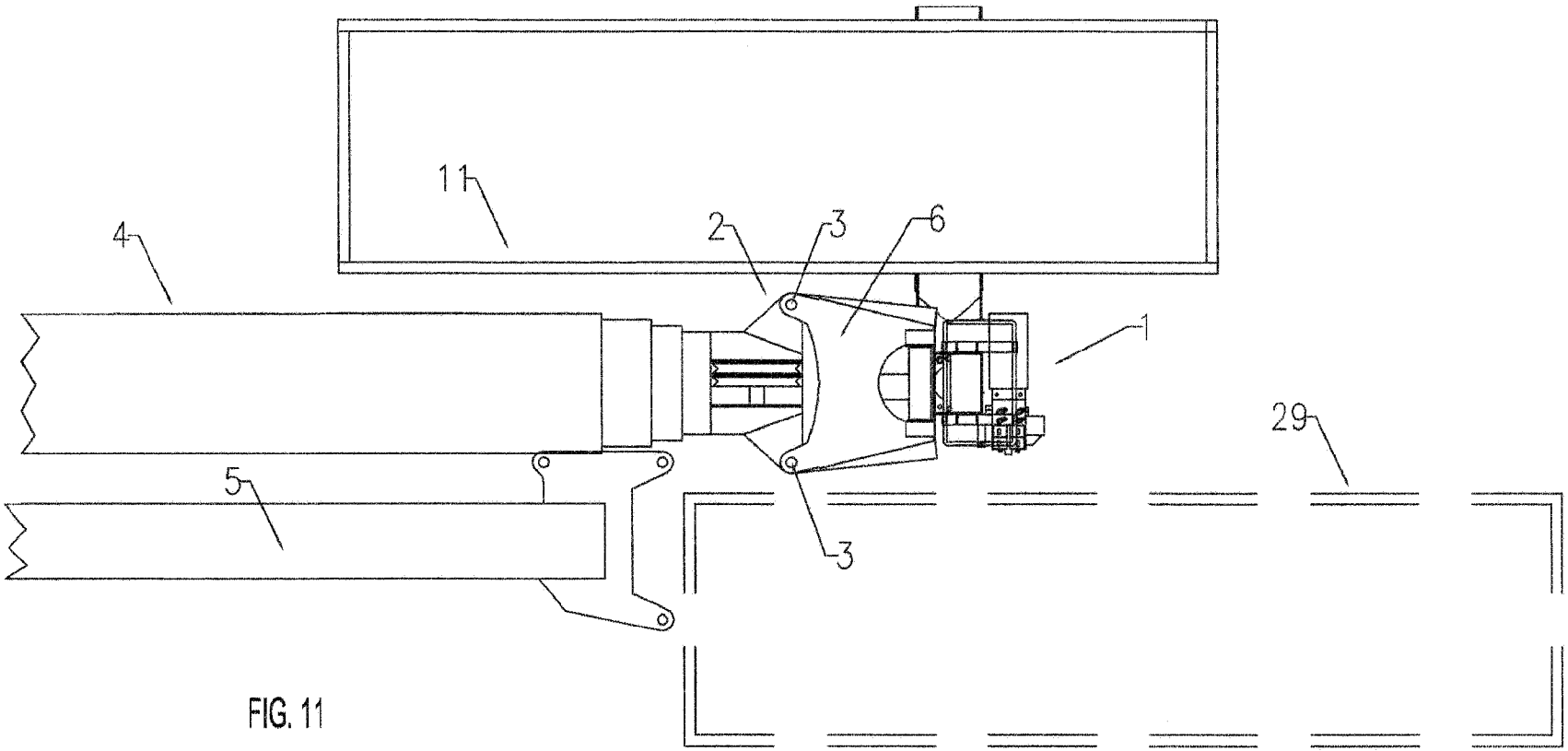
FIG. 11 is a top view of the association between the most preferred embodiment of the present invention work platform attachment, the swing-jib, the main crane boom, and the swing-jib sheave head mounting plates on the end of the crane boom previously shown in FIG. 9, with solid lines showing the present invention work platform attachment secured to the swing-jig sheave head mounting plates while it is in its road-travel-ready stowed position outboard and parallel to the crane boom, and the broken lines showing the present invention work platform attachment rotated approximately 180-degrees from its road-travel-ready and stowed position (represented by the solid lines).

FIG. 11 is a partial top view of FIG. 9 showing the most preferred embodiment 1 of the present invention leveling and rotation assembly, with its work platform attachment 11 illustrated in solid lines and to the main crane boom 4 via swing-jib sheave head mounting plates 2 connected via platform mounting member 6 and multiple swing-jib mounting pins 3 (provided with the mobile crane's swing-jib assembly 5). FIG. 11 also shows a crane swing-jib 5 in a stowed position parallel to main crane boom 4. In addition, FIG. 11 provides a second representation 29 of work platform attachment 11 in broken lines, which identifies the location and positioning work platform attachment 11 would attain after a 180-degree rotation from its outboard stowed position along one side of main crane boom 4. Furthermore, rotation of the most preferred embodiment of work platform attachment 11 can be stopped at any time while moving between the two positions of work platform attachment 11 shown in FIG. 11 by the solid and broken lines, and locked into a needed position. The approximate 180-degree rotation of the present invention work platform attachment 11 allows positioning flush, parallel, and perpendicular to any adjacent work surface, as well as adjustment to any angle necessary that allows easy worker access to an elevated job area. Also, its 180-degree rotation allows work platform attachment 11 to easily move around objects and obstacles confronted on many aerial work sites, often eliminating the need to reposition the vehicle associated with main crane boom 4 for access of personnel aboard work platform attachment 11 to the elevated work area.

Figure 12:
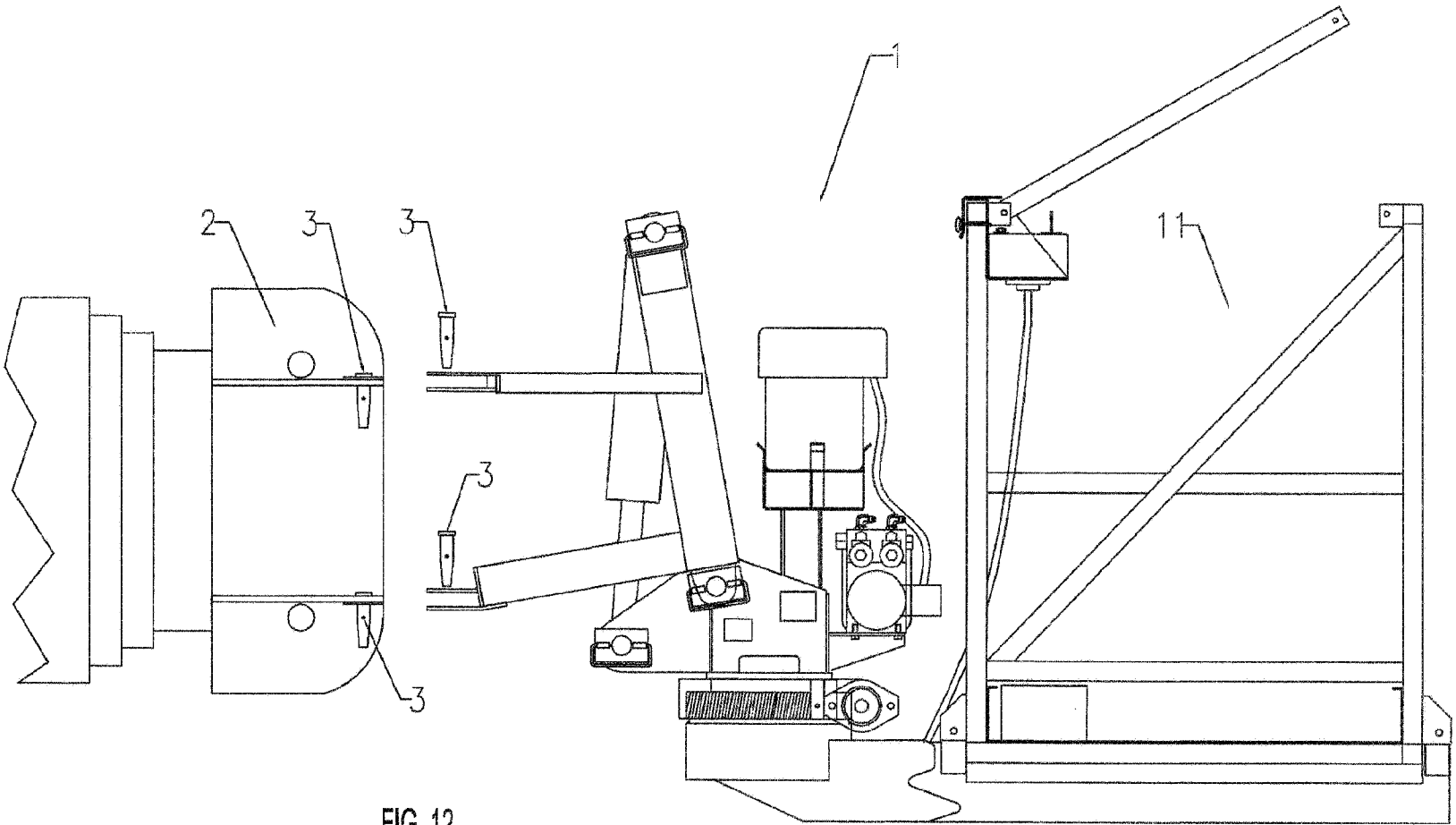
FIG. 12 is a side elevation view of the most preferred embodiment of the self-contained present invention work platform attachment and swing-jib sheave head mounting plates shown in FIG. 10, with the platform attachment lined up with, but not yet pinned to, the swing-jib sheave head.
Figure 13:
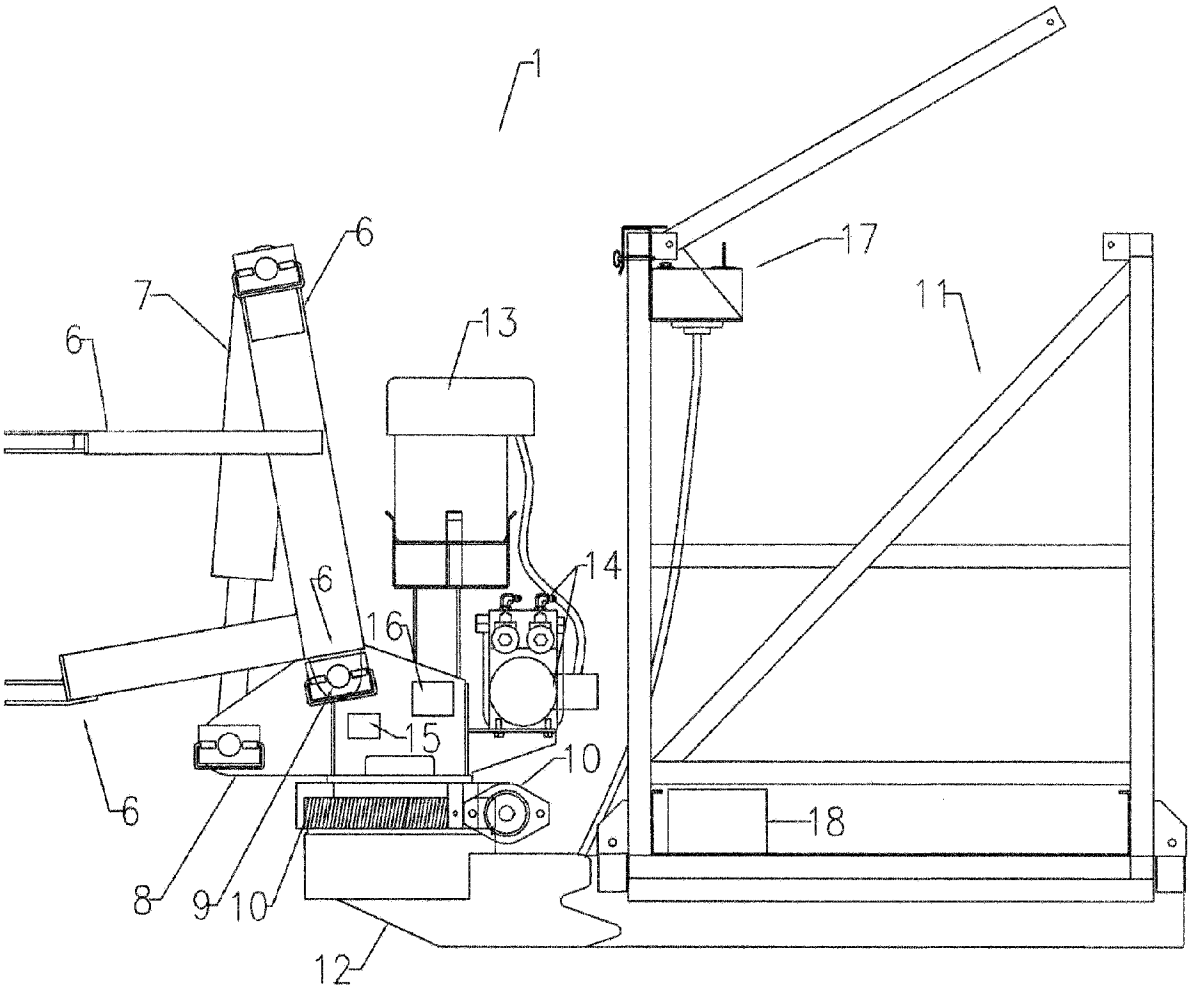
FIG. 13 is an enlarged side elevation view of the self-contained work platform in FIG. 12, with the left part of the illustration showing the attachment assembly that connects the work platform attachment to the swing-jib sheave head mounting plates on the end of a crane boom.
Figure 14:
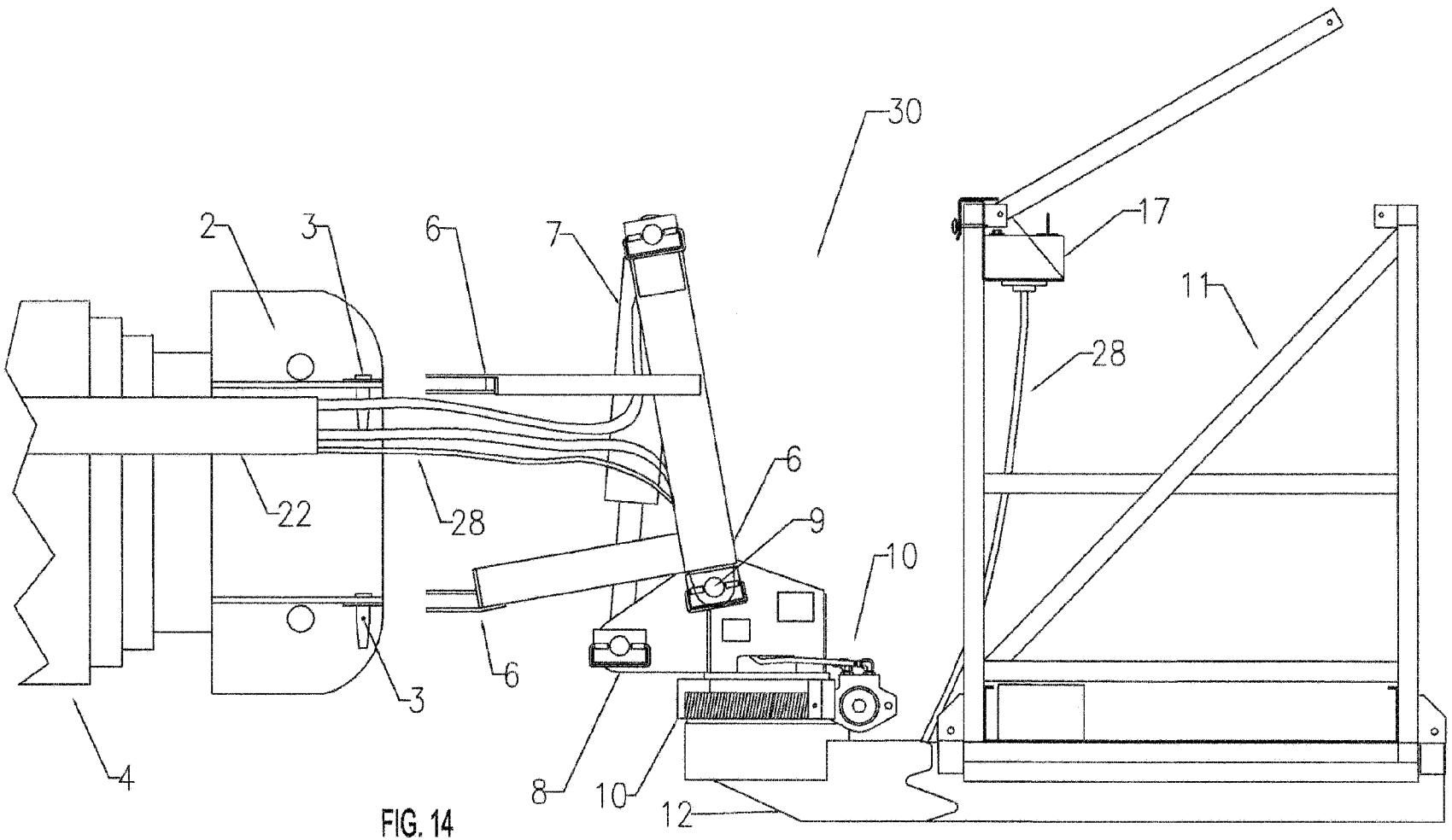
FIG. 14 is a side elevation view of a second preferred embodiment of the present invention work platform attachment similar to that shown in FIG. 13, having prompt pin attachment to swing-jig sheave head mounting plates and powered rotational and self-leveling capabilities, except it does not have the onboard hydraulic power package or battery power shown in FIG. 13, and in the alternative power is supplied to this work platform by the mobile crane's base vehicle or a remote source on the ground below.
Figure 15:
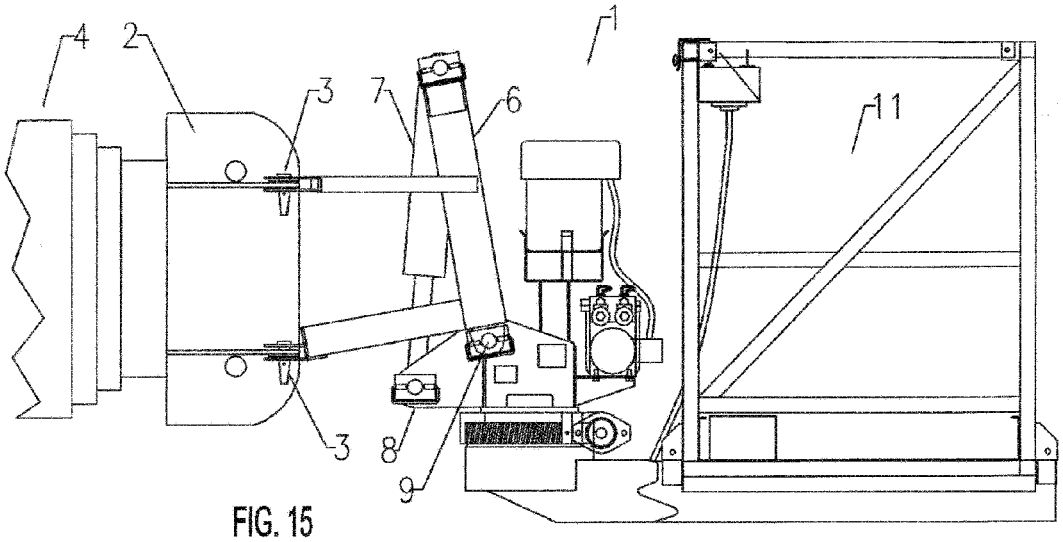
FIG. 15 is a side elevation view of the most preferred embodiment of the present invention work platform attachment secured to the swing-jib mounting plates on a crane boom that is level with the ground, with the work platform also positioned level with the ground as a result of its leveling cylinder holding, or continually maintaining, its top platform rotation base in the level orientation shown.
Figure 16:
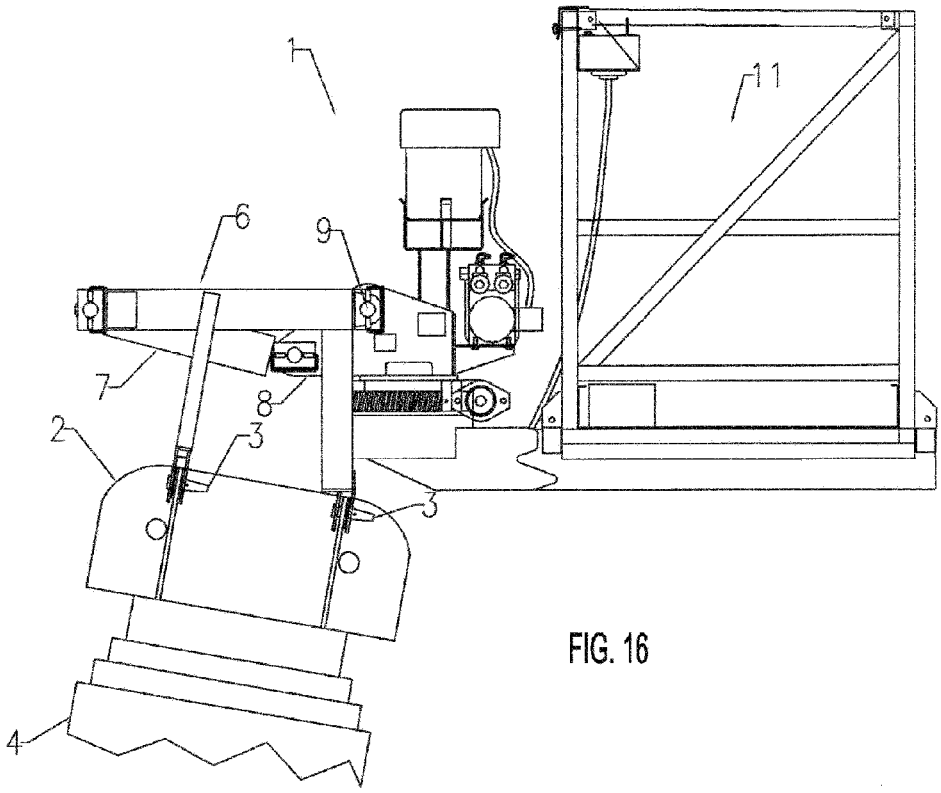
FIG. 16 is a side elevation view of the work platform attachment shown in FIG. 15 secured to the swing-jib mounting plates on a crane boom that is articulated upwardly at an approximate 80-degree angle relative to the ground, with the work platform still positioned level with the ground as a result of its leveling cylinder holding, or continually maintaining, its top platform rotation base in the level orientation displayed.
Figure 17:
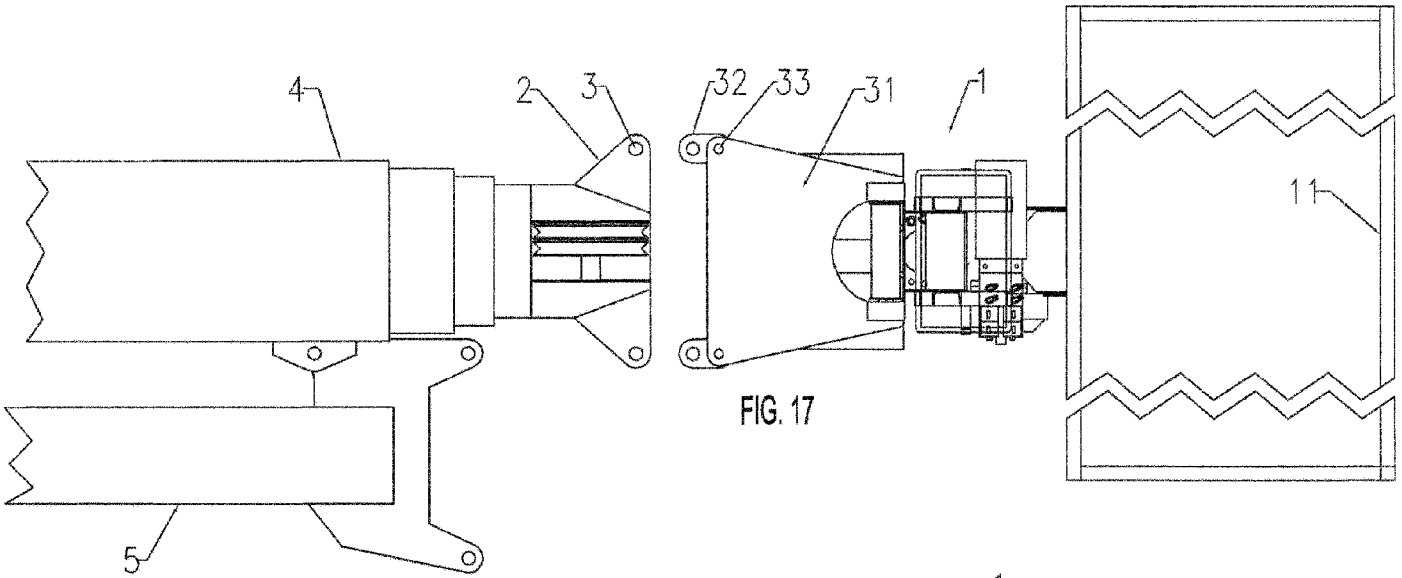
FIG. 17 is a top view of an alternative adjustable swing-jib mounting bracket connected to the most preferred embodiment of the present invention, with the most preferred embodiment of the present invention comprising mounting bracket pinning plates that are adjustable for use with various and different swing-jib sheave head designs.

FIGS. 12-13 and 15-18 show various features and structural components of the most preferred and self-powered embodiment 1 of the present invention, while FIG. 14 shows a second preferred embodiment 30 of the present invention that receives remote power for leveling and rotation functions via hoses and cables 22 and 28. Furthermore, FIGS. 12, 14-16, and 18 show work platform attachment 11 secured to sheave head mounting plates 2, while FIG. 13 shows an enlargement of the self-powered preferred embodiment 1 of the present invention (including its work platform attachment 11) and FIG. 17 shows its work platform attachment 11 secured to adjustable mounting plates 2. FIG. 12 is a side elevation view of the most preferred embodiment of self-contained platform assembly 1 lined up, but not yet secured to swing-jib sheave head mounting plates 2 via mounting pins 3. The illustration in FIG. 12 shows swing-jib sheave head mounting plates 2 on the left, work platform attachment 11 with its platform control processor 17 and foot activation switch 18 (see FIG. 13) on the right, and the assemblies needed for mounting connection, leveling operation, and rotation being positioned between the swing-jib sheave head mounting plates 2 and work platform attachment 11. FIG. 13 is an enlargement of everything in FIG. 12, omitting only the swing-jib sheave head mounting plates 2 and mounting pins 3, with additional component numbering added to provide further clarification and understanding of the features and advantages of the present invention. In FIG. 13, the part of the present invention positioned closest to the swing-jib sheave head mounting plates 2 (see FIG. 12) is platform mounting member 6 (see FIG. 11 for a top view thereof), which provides present invention connection to the swing-jib sheave head mounting plates 2 using the swing-jib's mounting pins 3 (as in FIG. 12). Platform mounting member 6, the top platform rotation base 8, and the rotation bearing drive assembly 10 are pinned together with hinge or pivot pins 9. Rotation bearing drive assembly 10 is the swivel joint that allows work platform attachment 11 to rotate through a maximum of approximately 180-degrees while platform mounting member 6, linear leveling actuator 7, and top platform rotation base 8 all stay in fixed attachment to the crane's swing-jib sheave head mounting plates 2. In addition, top platform rotation base 8 is connected to the top inside race drive of rotation bearing drive assembly 10, while platform support structure 12 is attached to the outer race of rotation bearing drive assembly 10, allowing the outer race of rotation bearing drive assembly 10 and all connected components (platform support structure 12, and work platform attachment 11) to rotate around the inner race. Thus, rotation bearing drive assembly 10 transfers all the bending and torsion loads from work platform attachment 11 through the top platform rotation base 8, hinge/pivot pin 9, platform mounting member 6, and finally to main crane boom 4 swing-jib sheave head mounting plates 2. Although not limited thereto, rotation bearing drive assembly 10 preferably comprises a slewing ring bearing and an integral hydraulic self-locking worm gear drive mechanism that forces platform support structure 12 to rotate a full 180-degrees.

Automated leveling for the work platform attachment 11 shown in FIG. 13 is provided by the electronic leveling-sensor 15 associated with top platform rotation base 8 and the hydraulic cylinder linear leveling actuator 7 connected between platform mounting member 6 and top platform rotation base 8. Hydraulic cylinder linear leveling actuator 7 extends or retracts when work platform attachment 11 is out-of-level, pushing or pulling top platform rotation base 8 and thus causing it to rotate about the hinge or pivot pin 9 as needed to adjust the level of work platform attachment 11. The cylinder shaft of linear leveling actuator 7 also causes top platform rotation base 8 and all associated components (rotation bearing drive assembly 10, platform support structure 12, and work platform attachment 11) to stay level during rotation about hinge/pivot pin 9 while main crane boom 4 is raised or lowered, regardless of payload/personnel balance or movement. Although not limited thereto, a 3-inch hydraulic cylinder may be used. When the planar bottom surface of top platform rotation base 8 is level, the associated components (rotation bearing drive assembly 10, platform support structure 12, and work platform attachment 11) will also be level. Platform support structure 12 and work platform attachment 11 are securely fastened together, and although work range and platform capacity are dependent upon the rated capacity of main crane boom 4, it is contemplated for a larger work platform attachment 11 associated with a 40-ton boom truck to support payload (not shown) weighing approximately 1000-pounds. As is also seen in FIG. 13, a self-contained power pack 13 and 14 are attached to top platform rotation base 8, which enables top platform rotation base 8 to also stay level when main crane boom 4 is raised or lowered. As long as the rotation bearing drive assembly 10 mounted to top platform rotation base 8 is level, the bottom platform support structure 12 will also be level as they are fastened to the same geometric plane. No matter where the bottom platform support structure 12 and attached work platform 11 are rotated, they will be kept level if the top platform rotation base 8 is level. Thus, the electronic level-sensor 15 that is shown in FIG. 13 associated with top platform rotation base 8, along with the assistance of control processor 17, foot activation switch 18, battery pack 13 with its associated cables, and the DC power unit 14 with its valves and fluid reservoir, sends hydraulic power to linear leveling actuator 7 for leveling of work platform attachment 11. Note that control processor 17 is also configured to operate the platform rotation drive mechanism 10, as it is contemplated for control processor 17 to have an override capability over the present invention's automated leveling function. In addition, the linear leveling actuator 7 has a safety locking mechanism to hold linear position in place should a hose or wire fail during the leveling operation. The component marked by the number 16 in FIG. 13 is a radio control receiver that controls at least part of the same functions as control processor 17.

FIG. 14 is a side elevation view of a second embodiment 30 of the present invention work platform attachment similar to that shown in FIG. 13, except without any onboard hydraulic power package or battery pack 13, with the power supply instead being provided via hoses and cables (22 and 28) associated with its supporting main crane boom 4. Thus, the present invention incorporates the prior art of aerial lift equipment by using a hose/cable carrier 22 or hose/cable reels (not shown) mounted to the side of main crane boom 4 which mechanically route hydraulic power to hydraulic cylinder linear leveling actuator 7, rotation bearing drive assembly 10, and control processor 17. Although not shown and not limited thereto, an embodiment of the present invention connected to a main crane boom 4 without swing-jib sheave head mounting plates 2 could also use the same mechanical routing of hydraulic power shown in FIG. 14

Figure 18:
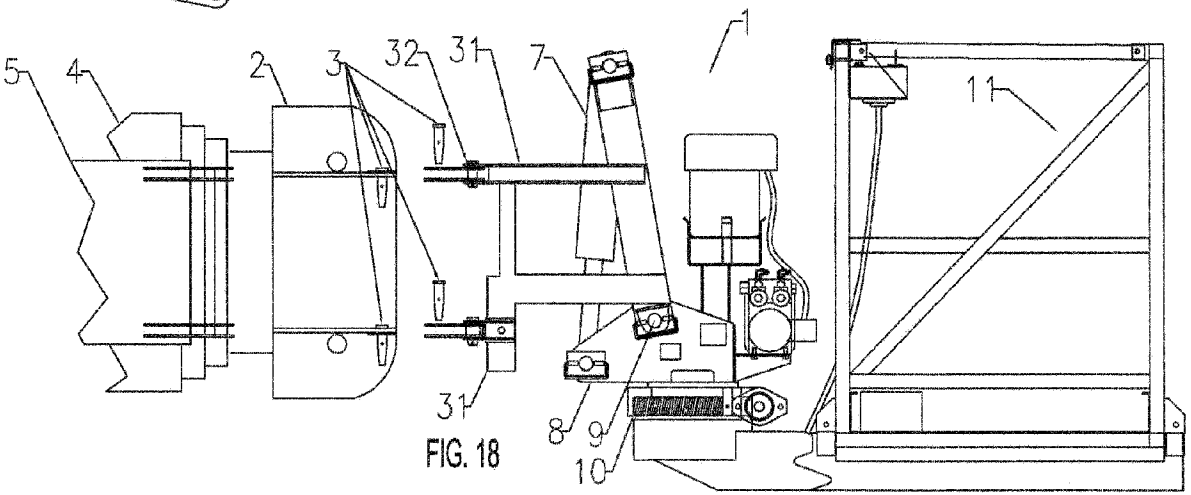
FIG. 18 is the side elevation view of the alternative adjustable swing-jib mounting bracket shown in FIG. 17 connected to the most preferred embodiment of the present invention, with the present invention comprising mounting bracket pinning plates that are adjustable for use with various and different swing-jib sheave head designs.

FIGS. 15-18 show other positions and connections for the most preferred embodiment 1 of the present invention. FIG. 15 shows main crane boom 4 in a horizontally-extending and substantially level orientation relative to the ground below it, and work platform attachment 11 also positioned level with the hydraulic cylinder of linear leveling actuator 7 holding (or keeping) top platform rotation base 8 level. As long as the rotation bearing drive assembly 10 mounted to top platform rotation base 8 is level, the bottom platform support structure 12 and work platform 11 will also be level, as they are fastened to the same geometric plane. Thus, no matter where the bottom platform support structure 12 and attached work platform 11 are rotated, they will be kept level if the top platform rotation base 8 is level, as is shown in FIG. 16 which illustrates a main crane boom 4 articulated up at an approximate 80-degree angle from crane boom 4 positioning in FIG. 15, and the work platform attachment 11 still positioned level since the hydraulic cylinder of linear leveling actuator 7 holds (or keeps) top platform rotation base 8 level. FIGS. 17 and 18 respectively show top and side elevation views of the present invention with an alternate swing-jib mounting bracket 31 substituted for the platform mounting member 6 shown in FIGS. 11-16. Alternate swing-jib mounting bracket 31 has a total of four adjustable mounting bracket pinning plates 32 that allow it to be secured to the mounting plates 2 of more than one design of swing-jib sheave head mounting plates 2. Alternate swing-jib mounting bracket 31 is preferably designed so that both of its adjustable pinning plates 32 in a horizontal plane rotate together (toward or apart from one another) about their respective pins 33. In addition to the horizontal adjustments about pins 33, it is preferred for the bottom mounting bracket pinning plates 32 on alternate swing-jib mounting bracket 31 to also adjust vertically up or down to match vertical spacing of a swing-jib sheave head's pinning hole spacing used for placement of mounting pins 3. This adjustable design of alternate swing-jib mounting bracket 31 enables the use of only one platform mounting bracket with many makes and brands of cranes.

Figure 19:
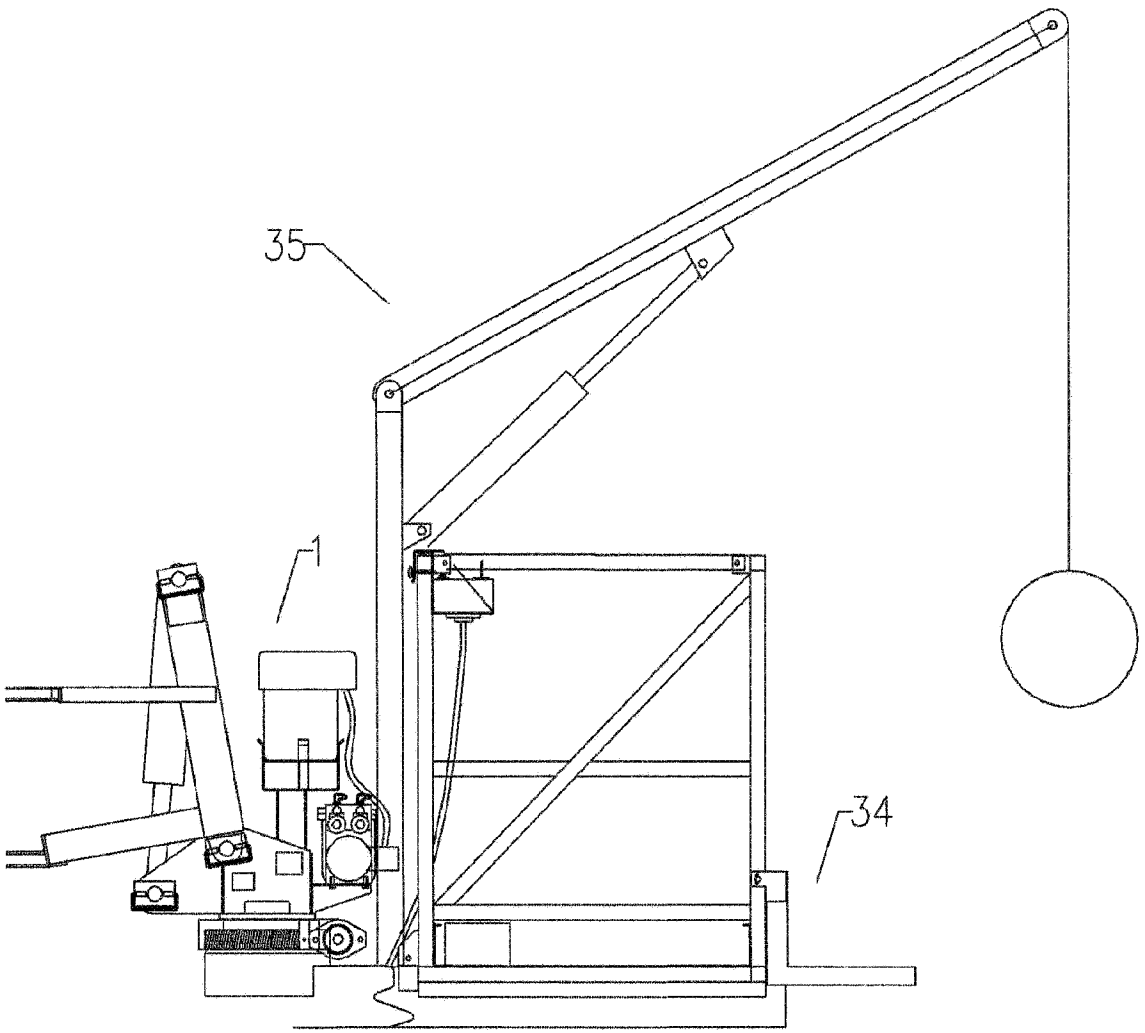
FIG. 19 is a side elevation view of the most preferred embodiment of the present invention comprising two optional features used for holding and/or transferring heavy objects outside the work platform attachment, a mini hydraulic platform crane with a lift cylinder and an electric winch, and pin-on lifting forks secured against the outside surface of the work platform attachment, which allows it to carry job-related supplies too large to fit inside the work platform attachment, carry objects too heavy for personnel to lift over the work platform attachment's side rails, and for a large object in place against a building (or other structure) while onboard personnel secure it in place.

FIG. 19 is a side elevation view of the most preferred embodiment of the present invention with two contemplated options for holding and/or transferring heavy objects outside the work platform attachment. The first and larger option shown in FIG. 19 is a mini hydraulic platform crane 35 with a lift cylinder with an electric winch able to position a load line outside of work platform attachment 11. Mini crane 35 is supported by platform support structure 12. It can transport a heavy object (such as a sign) to its intended location, hold it in place while personnel onboard work platform attachment 11 secure it in place, and pick up and transfer a heavy object at elevation from one location to another. The second option shown in FIG. 19 is one or more pin-on lifting forks 34 secured against the outside surface of work platform attachment 11 which can carry job-related supplies too large to fit inside it to a work site at elevation, carry objects too heavy for personnel to easily lift over work platform attachment 11 side rails, and hold one or more large objects in place against a building (or other elevated structure) while personnel secure them in place. The size, configuration, and location of attachment for mini hydraulic platform crane 35 and pin-on lifting forks 34 to work platform attachment 11 are provided only as an example, and may also be different from that shown in FIG. 19.

The following provides further explanation about features and advantages of the most preferred embodiment 1 of the present invention. Once most preferred embodiment 1 is attached to the mounting plates 2 of a swing-jib sheave head, it provides a solid base/anchor that can handle the rotational, torsion, and bending moments induced whether work platform attachment 11 is loaded and in a stationary position, is leveling through its articulation range (as shown in FIGS. 15 and 16), or is rotated through it's approximate 180-degree horizontal range of movement (shown in FIG. 11). As the associated main crane boom 4 is articulated up or down, work platform attachment 11 (see FIG. 13) is kept level by means of powered rotating movement about a hinge or pivot pin 9 while the hydraulic cylinder of its linear leveling actuator 7 extends or retracts to rotate top platform rotation base 8 and associated components (rotation bearing drive assembly 10, platform support structure 12, and work platform attachment 11), sufficient amounts to keep work platform attachment 11 level in relationship to the ground below it. The 180-degree rotation bearing drive assembly 10 and the linear leveling actuator 7 (preferably either a hydraulic cylinder or an electric rotary-screw actuator) are powered by the self-contained electrical and/or hydraulic power package shown in FIG. 13, including direct current (DC) battery pack 13, a hydraulic power pack 14 comprising a direct current (DC) motor, hydraulic pump, fluid reservoir, and proportional solenoid valves. Joystick controllers preferred as part of the control processor 17 onboard work platform 11 are also a part of the present invention's self-contained electrical power package, as is the electronic leveling sensor 15 that is necessary to keep work platform attachment 11 in a level orientation. In addition, to meet safety codes, a redundant radio remote package (of which the radio control receiver 16 in FIG. 13 is a part) that can control at least all key functions related to work platform attachment 11 from the ground is also a preferred part of the present invention's electrical power package. Also, convenient stowing of the present invention work platform attachment 11 for road-legal-travel while it remains attached to the main crane boom 4 is an important advantage of the present invention. As shown in FIG. 9, large and small work platform attachments 11 may be stowed parallel to main crane boom 4, while work platform attachments 11 that are shorter in length may also be stowed in front of main crane boom 4 and above the driver's vision, in an orientation perpendicular to main crane boom 4 (as shown in FIG. 10).

What is claimed is:

1. A universal work platform attachment for mobile and boom truck cranes, and telescopic boom assemblies, said work platform attachment comprising:

a platform mounting member in fixed connection to the distal end of a crane boom;

a top platform rotation base in fixed connection to, and substantially positioned below, said platform mounting member, said top platform rotation base having a bottom surface;

a rotation bearing drive assembly in fixed connection to said top platform rotation base and positioned below it, said rotation bearing drive assembly having a lower portion;

a bottom platform support structure in fixed connection to said lower portion of said rotation bearing drive assembly;

a work platform member having a bottom surface in fixed connection to said bottom platform support structure that causes said bottom surface of said work platform member and said rotation bearing drive assembly to become fastened to one another in the same geometric plane;

hinging means pivotally connected between said platform mounting member and said top platform rotation base, said hinging means further adapted for rotation of said work platform member through approximately 180-degrees starting from a position where said work platform member is on one side of the crane boom in its stowed position and positioned parallel to the crane boom, with said top platform rotation base and said platform mounting member staying in fixed orientation to the connected crane boom distal end during all rotation of said rotation bearing drive assembly from 0-degrees to approximately 180-degrees and while transferring all bending and torsion loads from said work platform member to the connected crane boom;

a linear leveling actuator connected between said platform mounting member and said top platform rotation base, and in fixed connection to said platform mounting member, said linear leveling actuator automatically extending and contracting different amounts in response to each instance of out-of-level positioning experienced by said work platform member, with said extension and contraction being proportional to an amount of out-of-level positioning said work platform member attains and also being commenced as often as needed to maintain said work platform member in a level orientation relative to the ground below it, said linear leveling actuator extending and contracting while the associated crane boom is raised and lowered, and also during rotation of said work platform member regardless of the positioning and movement of payload and personnel onboard said work platform member, and further irrespective of any cantilevered or off-set positioning, resulting in said rotation bearing drive assembly, said platform support structure, and said work platform member all being level when said bottom surface of said top platform rotation base is level, said linear leveling actuator also having a safety locking mechanism that maintains its current linear positioning in the event of other failure during leveling of said work platform member;

an electronic leveling sensor in fixed association with said top platform rotation base and also in electrical communication with said linear leveling actuator;

power supply means adapted for providing power to operate said electronic leveling sensor and said linear leveling actuator, said power supply means associated with said top platform rotation base and in electrical communication with said electronic leveling sensor and said linear leveling actuator; and at least one control processor associated with said work platform member and in electrical communication with said linear leveling actuator and said a rotation bearing drive assembly, wherein safety for personnel and payloads onboard said work platform member is enhanced when automated leveling of said work platform member takes place during its rotation and also during articulation of the connected crane boom, and safety is also enhanced by electrical communication of said at least one control processor with said linear leveling actuator when situations are encountered requiring override of said electronic leveling sensor.

2. The attachment of claim 1 wherein said platform mounting member is further configured for pinned connection to pre-established mounting holes of swing-jib sheave head mounting plates that are part of a swing-jib mounting system secured to the distal end of the crane boom.

3. The attachment of claim 2 further comprising a plurality of swing-jib mounting pins provided by the manufacturer of the swing-jib mounting system secured to the distal end of the crane boom, with said mounting pins complementary in size with the pre-established mounting holes that establishes a secure connection between said platform mounting member and the swing-jib sheave head mounting plates without any bolting, welding, or attachment of any other fixtures to the crane boom or crane boom tip.

4. The attachment of claim 1 wherein powered leveling for said work platform member is selected from a group consisting hydraulic-powered leveling assemblies, electric-powered leveling assemblies, and manually-powered leveling assemblies.

5. The attachment of claim 1 wherein said rotation bearing drive assembly is selected from a group consisting hydraulic-powered rotation assemblies, electric-powered rotation assemblies, and manually-powered rotation assemblies.

6. The attachment of claim 1 wherein said power supply means for said linear leveling actuator comprises a self-contained hydraulic power package with a direct current motor, a hydraulic reservoir, at least one electric-hydraulic solenoid valve, and at least one deep-cycle large-amp-hour battery.

7. The attachment of claim 1 wherein said at least one control processor associated with said work platform member further comprises an electronic control box with at least one electric joystick and at least one electrical switch in electrical communication with said power supply means and said leveling sensor, said electronic control box controlling auto-leveling of said work platform member, leveling override operations, and rotation of said work platform member.

8. The attachment of claim 7 further comprising a redundant ground-operated radio remote-control system configured to perform at least some leveling and rotation functions as said electronic control box.

9. The attachment of claim 1 wherein said rotation bearing drive assembly produces sufficient rotation to place said work platform member in a road-travel-ready stowed position outboard and parallel to a connected crane boom.

10. The attachment of claim 1 further comprising a redundant low-voltage backup control system allowing leveling and rotation functions to continue when voltage provided by said power supply means drops below 10.5 volts and said at least one control processor has become disabled, thus enabling the safe lowering of said work platform member to the ground for battery replacement.

11. The attachment of claim 1 further comprising additional features selected from a group consisting of pin-on lifting forks exteriorly attached to said work platform member that are configured to carry objects too large to fit inside said work platform member, pin-on lifting forks configured to position and hold objects in place while being secured, pin-on lifting forks configured to carry objects too heavy to manually transfer or manually lift out of said work platform member, and mini hydraulic platform cranes having a lift cylinder, an electric winch, and a load line.

12. The attachment of claim 1 wherein said power supply means is selected from a group consisting of self-contained power supplies onboard said work platform attachment, power supplies providing electrical power supplied at least in part from the mobile boom crane or telescopic boom assembly supporting said work platform attachment, power supplies providing hydraulic power supplied at least in part from the mobile boom crane or telescopic boom assembly supporting said work platform attachment, power supplies providing power supplied at least in part from the mobile boom crane or telescopic boom assembly supporting said work platform attachment via hose and cable carriers attached to crane boom supporting said work platform attachment, remote power supplies providing power supplied at least in part from an auxiliary engine, and power supplies providing power supplied at least in part from a large battery-powered unit.

13. The attachment of claim 1 wherein said platform mounting member further comprises adjustable mounting bracket pinning plates configured for being secured to mounting plates of more than one design of swing-jib sheave head.

14. The attachment of claim 1 wherein said rotation bearing drive assembly comprises a slewing ring bearing and an integral hydraulic self-locking worm gear drive mechanism that forces said platform support structure to rotate 180-degrees.

15. The attachment of claim 1 further comprising a foot-activated on-off switch associated with said work platform member and in electrical communication with said electronic leveling sensor.

16. The attachment of claim 1 wherein said rotation bearing drive assembly further comprises a shear ball bearing and hydraulic gear drive mechanism allowing cantilevered mounting of said work platform member in an offset position relative to a connected crane boom, with continuous level orientation being maintained for said work platform member in all positions of rotation from 0-degrees to 180-degrees.

17. The attachment of claim 7 wherein said power supply means comprises a deep cycle marine battery, motor operating on direct current, a gear pump, a fluid reservoir, at least one proportional direct current solenoid valve, an on/off switch, a foot actuated on/off switch enabling leveling operations, and at least one control joystick associated with said control box enabling rotation operations.

18. The attachment of claim 1 wherein said work platform member has a compact design and configuration allowing it to remain pinned to the swing jib sheave head of a boom truck crane's boom while it is stowed over the truck's chassis cab, with said compact design and configuration causing said work platform member to fit within a required height-and-width envelope for road-legal-travel while also preventing obstruction of a driver's windshield vision.

19. The attachment of claim 18 wherein said compact design and configuration of said work platform member and said connection of said bottom platform support structure to said rotation bearing drive assembly that causes said bottom surface of said work platform member and said rotation bearing drive assembly to become fastened to one another in the same geometric plane, further allows said work platform member to be positioned above the top side of the associated crane boom at all times.

20. The attachment of claim 1 further comprising:

said platform mounting member further configured for pinned connection to pre-established mounting holes of swing-jib sheave head mounting plates that are part of a swing-jib mounting system secured to the distal end of a crane boom;

a foot-activated on-off switch associated with said work platform member and in electrical communication with said electronic leveling sensor;

said work platform member has a compact design and configuration allowing it to remain pinned to the swing jib sheave head mounting plates of a boom truck crane's boom while it is stowed over the truck's chassis cab, with said compact design and configuration causing said work platform member to fit within a required height-and-width envelope for road-legal-travel while also preventing obstruction of a driver's windshield vision;

said power supply means comprises a deep cycle marine battery, motor operating on direct current, a gear pump, a fluid reservoir, at least one proportional direct current solenoid valve, an on/off switch, a foot actuated on/off switch enabling leveling operations, and at least one control joystick associated with said control box enabling rotation operations; and a redundant ground-operated radio remote-control system configured to meet aerial lift safety codes and allow personnel on the ground to control leveling and rotation operations for said work platform member.

* * * * *